US011385576B2

(12) United States Patent
Saeki

(10) Patent No.: US 11,385,576 B2
(45) Date of Patent: Jul. 12, 2022

(54) PRINTING APPARATUS AND CONTROL METHOD THEREOF

(71) Applicant: CANON KABUSHIKI KAISHA, Tokyo (JP)

(72) Inventor: Tsuyoshi Saeki, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/011,216

(22) Filed: Sep. 3, 2020

(65) Prior Publication Data

US 2021/0072675 A1 Mar. 11, 2021

(30) Foreign Application Priority Data

Sep. 10, 2019 (JP) ..... JP2019-164785

(51) Int. Cl.
*G03G 15/20* (2006.01)
*G03G 21/16* (2006.01)

(52) U.S. Cl.
CPC ..... *G03G 15/2017* (2013.01); *G03G 15/2039* (2013.01); *G03G 21/1685* (2013.01); *G03G 2221/1639* (2013.01)

(58) Field of Classification Search
CPC ..... G03G 15/2017; G03G 15/2039; G03G 21/1685; G03G 2221/1639
See application file for complete search history.

(56) References Cited

U.S. PATENT DOCUMENTS

| | | | | |
|---|---|---|---|---|
| 7,856,187 | B2 | 12/2010 | Kenichi | |
| 2009/0245826 | A1* | 10/2009 | Dan | G03G 21/206 399/44 |
| 2010/0073407 | A1* | 3/2010 | Sekimoto | B41J 2/0057 347/1 |
| 2013/0004203 | A1* | 1/2013 | Ohnishi | G03G 21/1633 399/122 |
| 2013/0142526 | A1 | 6/2013 | Numazu et al. | |
| 2017/0277085 | A1* | 9/2017 | Abe | G03G 15/652 |
| 2019/0187593 | A1* | 6/2019 | Ishizuka | G03G 15/5004 |

FOREIGN PATENT DOCUMENTS

| | | | |
|---|---|---|---|
| JP | 2002-014556 | A | 1/2002 |
| JP | 2003-316221 | A | 11/2003 |
| JP | 2005-258264 | A | 9/2005 |
| JP | 2009-244504 | A | 10/2009 |
| JP | 2013-140322 | A | 7/2013 |

* cited by examiner

*Primary Examiner* — Clayton E. LaBalle
*Assistant Examiner* — Michael A Harrison
(74) *Attorney, Agent, or Firm* — Venable LLP

(57) ABSTRACT

There is provided with a printing apparatus. A printing unit prints an image on a print medium. A heating unit heats the print medium with the image printed thereon. A detection unit detects a temperature of the heating unit. A housing accommodates the printing unit and the heating unit. An openable/closable cover member is provided on the housing and covers the heating unit. A restricting unit is capable of restricting an opening operation of the cover member. A control unit controls the restricting unit so as to execute the restriction if the temperature of the heating unit exceeds a first threshold value, and release the restriction if the temperature of the heating unit is not more than a second threshold value lower than the first threshold value.

19 Claims, 19 Drawing Sheets

PRINTING APPARATUS AND CONTROL METHOD THEREOF

BACKGROUND OF THE INVENTION

Field of the Invention

The present invention relates to a printing apparatus and a control method thereof.

Description of the Related Art

Conventionally, there is known a printer including a heating device represented by a fixing device in a conveyance path of a print medium. In such a printer, the heating device may be inserted into and removed from the printer main body at the time of jam clearance or replacement of the fixing device. Since the heating device may be in a high temperature state caused by its operation, there is disclosed a technique of disabling insertion/removal of the heating device to/from the printer main body if the fixing device is at a temperature equal to or higher than a predetermined temperature, and enabling such insertion/removal if the fixing device is below the predetermined temperature (Japanese Patent Laid-Open No. 2013-140322).

SUMMARY OF THE INVENTION

According to one embodiment of the present invention, a printing apparatus comprises, a printing unit configured to print an image on a print medium, a heating unit configured to heat the print medium with the image printed thereon, a detection unit configured to detect a temperature of the heating unit, a housing configured to accommodate the printing unit and the heating unit, an openable/closable cover member provided on the housing and configured to cover the heating unit, a restricting unit capable of restricting an opening operation of the cover member, and a control unit configured to control the restricting unit so as to execute the restriction if the temperature of the heating unit exceeds a first threshold value, and release the restriction if the temperature of the heating unit is not more than a second threshold value lower than the first threshold value.

According to another embodiment of the present invention, a control method of a printing apparatus including a printing unit configured to print an image on a print medium, a heating unit configured to heat the print medium with the image printed thereon, a housing configured to accommodate the printing unit and the heating unit, an openable/closable cover member provided on the housing and configured to cover the heating unit, and a restricting unit capable of restricting an opening operation of the cover member, the method comprises, detecting a temperature of the heating unit, and controlling the restricting unit so as to execute the restriction if the temperature of the heating unit exceeds a first threshold value, and release the restriction if the temperature of the heating unit is not more than a second threshold value lower than the first threshold value.

Further features of the present invention will become apparent from the following description of exemplary embodiments (with reference to the attached drawings).

DESCRIPTION OF THE EMBODIMENTS

Figure 1:
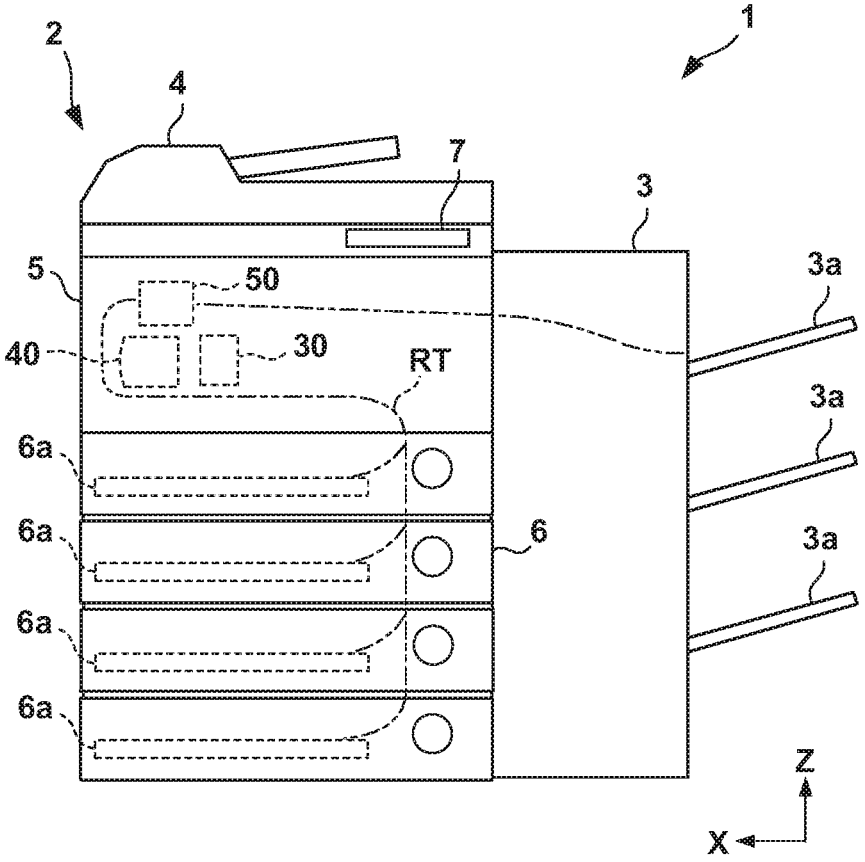
FIG. 1 is a front view of a printing system.

The above-described conventional technique only disables the insertion/removal so that the heating device may be exposed to the outside. There is room for improvement in this point.

An embodiment of the present invention provides a technique of suppressing exposure of the device in a high temperature state to the outside.

Hereinafter, embodiments will be described in detail with reference to the attached drawings. Note, the following embodiments are not intended to limit the scope of the claimed invention. Multiple features are described in the embodiments, but limitation is not made an invention that requires all such features, and multiple such features may be combined as appropriate. Furthermore, in the attached drawings, the same reference numerals are given to the same or similar configurations, and redundant description thereof is omitted.

<Arrangement of Printing System>

FIG. 1 is a front view of a printing system 1 according to an embodiment of the present invention. In the drawings including FIG. 1, arrows X and Y indicate a horizontal direction and a depth direction, respectively, which are perpendicular to each other. An arrow Z indicates a vertical direction.

The printing system 1 includes a main body apparatus 2 and a post processing apparatus 3. The main body apparatus 2 according to this embodiment is an apparatus forming a multi-function peripheral, and has a copy function, a scanner function, and a printer function. The main body apparatus 2 includes a reading apparatus 4, a printing apparatus 5, and a feeding apparatus 6, and an operation unit 7 is provided in the front portion of the main body apparatus 2. The operation unit 7 serves as an input/output interface with a user, and includes, for example, an acceptance unit such as hard keys that accepts input from the user, and a display unit 7*a* such as a liquid crystal display that displays information. The operation unit 7 may be a touch panel that serves as the display unit 7*a* to accept input from the user and display information. The operation unit 7 also includes an output unit such as a voice generator.

The reading apparatus 4 includes an ADF (Automatic Document Feeder), and conveys stacked documents and reads document images. The feeding apparatus 6 is an apparatus that feeds a print medium to the printing apparatus 5. In this embodiment, the print medium is a sheet such as paper or a film, and is particularly a cut sheet. The print medium may be referred to as a sheet hereinafter. The feeding apparatus 6 includes a plurality of cassettes 6*a* on which sheets are stacked, and a feeding mechanism (not shown) that feeds a sheet from the cassette 6*a* to the printing apparatus 5 on a conveyance path RT.

The printing apparatus 5 prints an image on the sheet. The printing apparatus 5 includes a printing unit 30 that prints an image by discharging ink to a sheet, and a first drying promotion unit 40 and a second drying promotion unit 50 that promote drying of the sheet. Details of the printing apparatus 5 will be described later.

The post processing apparatus 3 serves as a finisher (sheet processing apparatus) that is separably attached to a side portion of the main body apparatus 2 as an optional apparatus and performs post processing of the sheet. The post processing includes, for example, a stacking processing of stacking, on a tray 3*a*, a sheet discharged from the printing apparatus 5, a sort processing of taking in a plurality of sheets discharged from the printing apparatus 5 and aligning and bundling them, stapling processing of binding bundled sheets by staplers, binding processing, and punching processing.

<Arrangement of Printing Apparatus>

Figure 2:
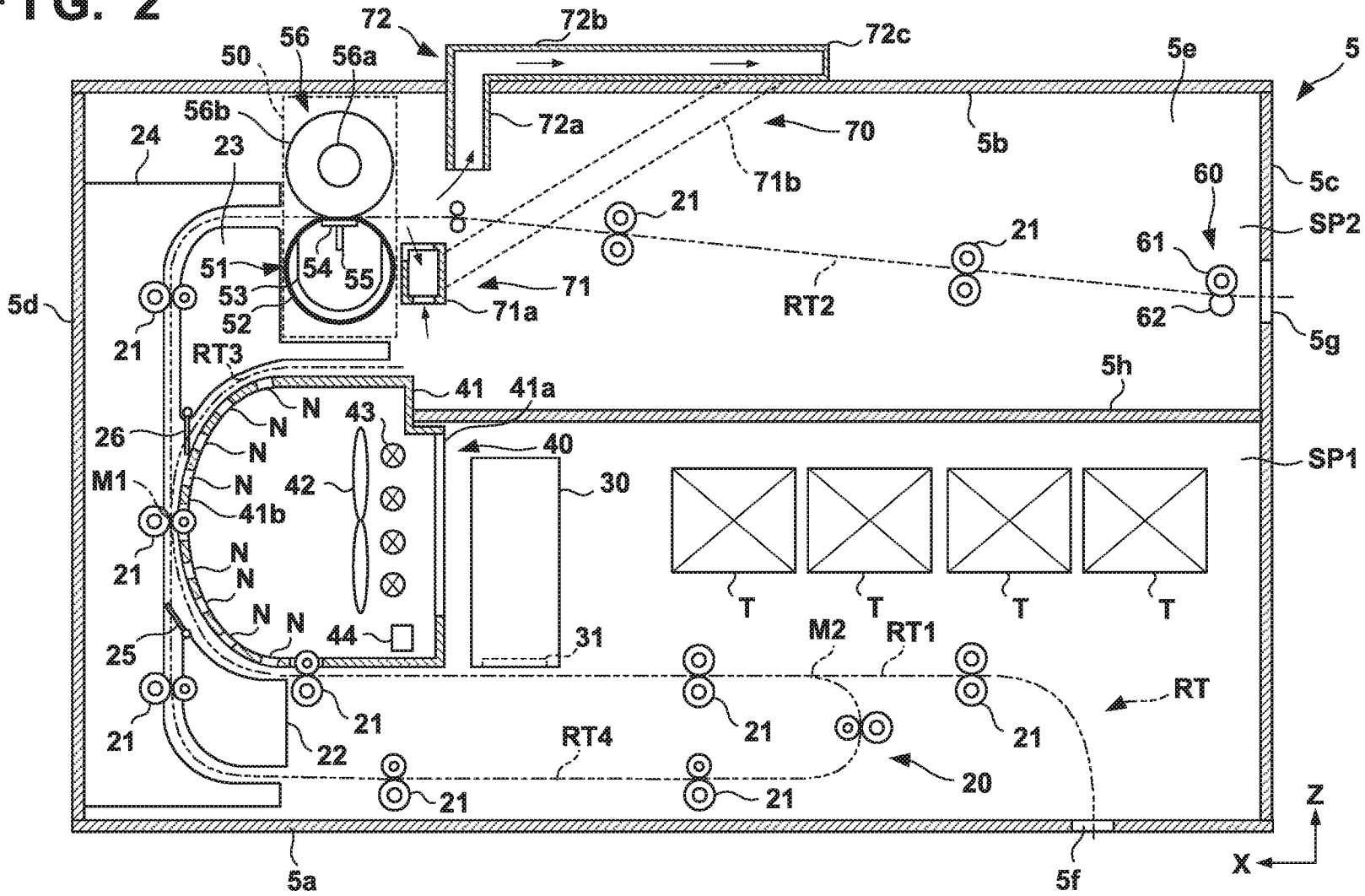
FIG. 2 is a schematic view of a printing apparatus.

FIG. 2 is an explanatory view showing the internal arrangement of the printing apparatus 5. The printing apparatus 5 includes, as a frame for supporting the internal mechanism, a bottom wall portion 5*a*, an upper wall portion 5*b*, a right wall portion 5*c*, a left wall portion 5*d*, and a back wall portion 5*e*. These wall portions define the internal space of the printing apparatus 5. The internal space of the printing apparatus 5 is divided into a lower space SP1 and an upper space SP2 by a partition wall 5*h*. The spaces SP1 and SP2 are not hermetically divided, and communicate with each other.

The bottom wall portion 5*a* includes an opening 5*f* through which a sheet fed from the feeding apparatus 6 passes. The right wall portion 5*c* includes an opening 5*g* through which a sheet passes to be discharged to the post processing apparatus 3. For example, the left wall portion 5*d* and the right wall portion 5*c* may be supported to be opened/closed in a door type for maintenance. Alternatively, for example, an opening may be partially formed in each of the left wall portion 5*d* and the right wall portion 5*c* for maintenance, and a cover member may be provided so as to cover each opening.

In this embodiment, for jam clearance, replacement of the second drying promotion unit 50, and the like, the left wall portion 5*d* is pivotably supported. That is, in this embodiment, the bottom wall portion 5*a*, the upper wall portion 5*b*, the right wall portion 5*c*, the back wall portion 5*e*, and the like form a housing 5*i* of the printing apparatus 5, and the left wall portion 5*d* serves as the cover member that covers an opening 5*j* formed in the housing 5*i*. The left wall portion 5*d* may be referred to as the cover member 5*d* hereinafter. In addition, in this embodiment, the printing apparatus 5 includes a restricting mechanism 80 (see FIGS. 10 and 11, and the like) capable of restricting the opening operation of the cover member 5*d* and releasing the restriction.

The printing apparatus 5 includes a conveyance unit 20, the printing unit 30, the first drying promotion unit 40, the second drying promotion unit 50, a correction unit 60, and an exhaust unit 70.

<Conveyance Unit>

The conveyance unit 20 is a mechanism that conveys a sheet along the conveyance path RT. In this embodiment, the conveyance path RT is a path which has the opening 5*f* as an upstream end and the opening 5*g* as a downstream end and on which the sheet is conveyed. The conveyance path RT includes main paths RT1 and RT2, a switch-back path RT3, and an inverting path RT4. The main paths RT1 and RT2 are paths from the opening 5*f* to the opening 5*g* via an intermediate point M1. The main path RT1 is a path from the opening 5*f* to the intermediate point M1, and the main path RT2 is a path from the intermediate point M1 to the opening 5*g*. The main paths RT1 and RT2 are paths on which the sheet is conveyed leftward→upward→rightward, and the sheet passes through the printing unit 30→first drying promotion unit 40→second drying promotion unit 50→correction unit 60. For one-sided print of printing on only one surface of the sheet, the sheet is conveyed through the main paths RT1 and RT2.

The switch-back path RT3 and the inverting path RT4 are paths on which the sheet is conveyed after printing on one surface for double-sided print of printing on both surfaces of the sheet. The switch-back path RT3 forms a path from the intermediate point M1, which is different from the main path RT2. The inverting path RT4 is a path from the intermediate point M1 to a midway joining point M2 on the main path RT1. The sheet is inverted via the inverting path RT4, and is returned to the main path RT1 again.

When referring to the downstream side and the upstream side in the following description, the conveyance direction of the sheet on the conveyance path RT is set as a reference.

The conveyance unit 20 includes a driving mechanism that applies a conveying force to the sheet, and a guide that guides conveyance of the sheet along the conveyance path RT, and FIG. 2 shows part of the conveyance unit 20. The driving mechanism includes a plurality of conveyance rollers 21 driven by a driving source such as a motor. For each conveyance roller 21, a driven roller or a spur is arranged to face it. The sheet is conveyed while being nipped between each conveyance roller 21 and its corresponding driven roller or spur. The spur is arranged to contact a printing surface in a region on the downstream side with respect to the printing unit 30 in order to retain the quality of a printed image. The guide includes guide members 22 to 24. The guide member 24 is supported by the left wall portion 5*d*. Part of the conveyance path RT is formed between the guide members 23 and 24 and part of the main path RT1 is formed between the guide members 22 and 24.

Figure 3:
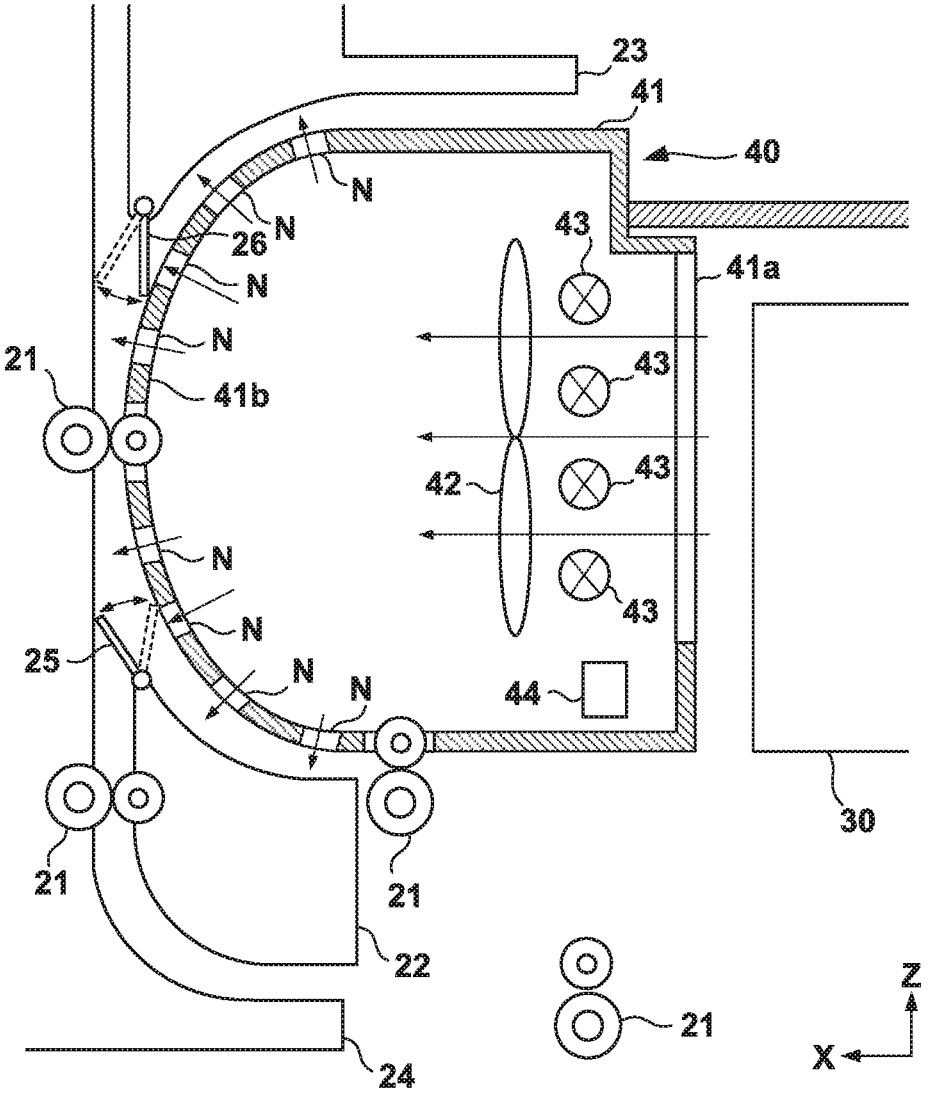
FIG. 3 is an explanatory view of a drying promotion unit.

The conveyance unit 20 includes path switching units 25 and 26. The path switching units 25 and 26 are units that switch the guiding path of the sheet, and are operated by a driving source such as an electromagnetic solenoid or a motor. For one-sided print, the path switching units 25 and 26 guide the sheet from the main path RT1 to the main path RT2. For double-sided print, the path switching units 25 and 26 guide the sheet from the main path RT1 to the switch-back path RT3, and guide the switched-back sheet to the inverting path RT4. FIG. 3 shows the path switching mode of the path switching units 25 and 26. The path switching units 25 and 26 each include a pivotable flap, and switch the path by the positions of the flaps. The positions indicated by solid lines are those for one-sided print, and the positions indicated by broken lines are those for double-sided print.

<Printing Unit>

Referring back to FIG. 2, the printing unit 30 includes printheads 31, and each printhead 31 is an inkjet head that forms an image (ink image) by discharging ink to a sheet. Inks to be discharged by the printheads 31 are reserved in a plurality of ink reservoirs T. The ink reservoirs T are provided for the respective kinds of inks. The kinds of inks are, for example, yellow, magenta, cyan, and black as kinds of colors.

The printheads 31 are provided for the respective kinds of inks. In this embodiment, each printhead 31 is a full-line head extended in the Y direction, and nozzles are arrayed within a range where they cover the width of an image printing area of a sheet having a usable maximum size. Each printhead includes a lower surface facing the sheet via a minute gap (for example, several mm), and the lower surface forms an ink discharge surface with the opened nozzle.

Each nozzle includes a discharge element. The discharge element is, for example, an element that generates a pressure in the nozzle and discharges ink in the nozzle, and the technique of a known inkjet head is applicable. Examples of the discharge element are an element that discharges ink by causing film boiling in ink with an electrothermal transducer and forming a bubble, an element that discharges ink by an electromechanical transducer, and an element that discharges ink by using static electricity. The discharge element that uses the electrothermal transducer can be used to perform high-speed and high-density printing.

Note that the printing unit 30 may be a serial-type printing unit in which printheads mounted on a carriage execute printing by reciprocally moving in the width direction of a sheet. The number of kinds of discharged inks may be one, for example, only black ink may be discharged. As the print mode of the printing unit 30, a print mode of a single ink or a print mode of a plurality of kinds of inks can be selected. Each ink may mainly contain a coloring material (dye or pigment) and a solvent component. As a solvent component, a water-based material can be used. As a dye, for example, a water-soluble dye represented by a direct dye, an acid dye, a basic dye, a reactive dye, an edible pigment, or the like is preferable. However, any dye may be used as long as an image that satisfies a fixing property, color development, sharpness, stability, light resistance, and other required properties in combination of the print medium is obtained. As a pigment, carbon black or the like is preferable. Any of a method using a pigment and a dispersant, a method using a self-dispersion type pigment, and a method of performing microencapsulation can be used. Furthermore, ink can be used by adding, as appropriate, various additives such as a solvent component, a solubilizer, a viscosity modifier, a surfactant, a surface tension regulator, a pH adjuster, and a resistivity modifier.

<Drying Promotion Unit>

A sheet on which an image has been printed by the printing unit 30 may be expanded due to the liquid of the ink, and may be waved. Such sheet causes a paper jam in the printing apparatus 5 or degrades stackability/alignment in the post processing apparatus 3. By promoting drying of the sheet, it is possible to suppress expansion of the sheet caused by the liquid of the ink. The printing apparatus 5 according to this embodiment includes the plurality of drying promotion units, that is, the first drying promotion unit 40 and the second drying promotion unit 50 of different sheet drying methods.

The first drying promotion unit 40 is a unit that is arranged on the downstream side with respect to the printing unit 30 and promotes drying of the sheet by blowing warm air to the sheet without contacting the sheet. The structure of the first drying promotion unit 40 will be described with reference to FIGS. 2 and 3.

The first drying promotion unit 40 includes a hollow body 41 that defines the internal space, and a fan 42 and heating elements 43 all of which are arranged in the hollow body 41. The hollow body 41 includes an air intake port 41*a* in a right portion. A wall portion 41*b* that forms the left portion of the hollow body 41 is a guide wall portion also serving as a sheet conveyance guide, and is extended in the Y direction to cover the width of a sheet having the maximum size. The guide wall portion 41*b* has a C-shaped sectional shape (a section on an X-Z plane), and includes a wall surface facing the guide members 22 to 24. Part of the conveyance path RT is formed between the wall surface and the guide members 22 to 24, and the intermediate point M1 is also set. In the guide wall portion 41*b*, a number of warm air blowing holes N communicating with the internal space of the hollow body 41 are formed.

The fan 42 is an electric fan that uses a motor as a driving source, and is, for example, a sirocco fan. The fan 42 introduces air from the air intake port 41*a* into the hollow body 41. The pressure in the hollow body 41 increases by the introduced air, and the air in the hollow body 41 is blown out of the hollow body 41 from the blowing holes N. One fan 42 may be provided or a plurality of fans 42 may be juxtaposed in the Y direction.

The heating elements 43 heat the air introduced by the fan 42 from the air intake port 41*a* into the hollow body 41. In this embodiment, each heating element 43 is a rod-like heating element such as an infrared lamp heater, and is extended in the Y direction. The plurality of heating elements 43 are arrayed in the Z direction. The plurality of heating elements 43 are arranged between the fan 42 and the air intake port 41*a*, and the air introduced from the air intake port 41*a* into the hollow body 41 is heated when it passes through the heating elements 43. A temperature sensor 44 is provided in the first drying promotion unit 40, and driving of the heating elements 43 is controlled in accordance with the detection result of the temperature sensor 44.

With this arrangement, the first drying promotion unit 40 blows warm air from the blowing holes N, as indicated by an airflow represented by arrows in FIG. 3. This can heat the sheet passing through the conveyance path RT, and promote evaporation of a liquid contained in the ink image on the sheet, thereby promoting drying of the sheet.

The second drying promotion unit 50 is a thermal fixing unit that is arranged on the downstream side with respect to the first drying promotion unit 40 and promotes drying of the sheet by heating the sheet in contact with the image printing surface of the sheet. The structure of the second drying promotion unit 50 will be described with reference to FIG. 2.

The second drying promotion unit 50 includes a heater 51 and a roller 56, which are extended in the Y direction to cover the width of a sheet having the maximum size. The heater 51 includes a support member 53 that supports a heating element 54. The heating element 54 is, for example, a ceramic heater, and is extended in the Y direction. The temperature of the heating element 54 is detected by a temperature sensor 55 represented by a thermistor, and driving of the heating element 54 is controlled based on a detection result.

The support member 53 also supports a film 52. The film 52 is formed in a cylindrical shape and extended in the Y direction. The film 52 is supported by the support member 53 to be rotatable about the support member 53, and is interposed between the roller 56 and the heating element 54. The film 52 is, for example, a single-layer film or composite layer film having a film thickness of 10 μm (inclusive) to 100 μm (inclusive). When the film 52 is a single-layer film, for example, PTFE, PFA, or FEP is used as a material. When the film 52 is a composite film, for example, it is a film with a layer structure that covers or coats a layer of polyimide, polyamide-imide, PEEK, PES, PPS, or the like with PTFE, PFA, FEP, or the like.

Note that the arrangement of the heater 51 is not limited to this, and may have, for example, a structure that includes a heating element such as a halogen heater in a hollow metal core and covers the periphery of the core with an elastic body such as a silicone rubber.

The roller 56 is formed by covering the periphery of a core 56*a* with an elastic body 56*b* such as a silicone rubber. The roller 56 is pressed against the heater 51 by a predetermined pressing force, and the roller 56 and the heater 51 form a nip portion. The roller 56 is rotated using a motor as a driving source, and the film 52 rotates together with the roller 56. With this arrangement, the sheet is heated while being conveyed in the nip portion, thereby making it possible to promote drying of the sheet.

In this embodiment, the first drying promotion unit 40 and the second drying promotion unit 50 dry the sheet in two stages. However, only the second drying promotion unit 50 may be provided.

<Correction Unit>

The correction unit 60 is a mechanism that corrects the curvature (curl in this example) of a sheet. In this embodiment, the correction unit 60 includes a large-diameter driving roller 61 and a small-diameter driven roller 62. The driving roller 61 is a roller obtained by covering the periphery of a core with an elastic body such as a silicone rubber. The driven roller 62 is a metal roller. The driving roller 61 and the driven roller 62 are in press contact with each other. When a sheet passes between the driving roller 61 and the driven roller 62, these rollers can apply a pressure to the sheet to correct the curl of the sheet. The correction unit 60 can apply, to the sheet, a correction force in, for example, an upwardly-convex direction. In this case, the correction unit 60 can correct a sheet having a downwardly-convex curl to a flatter state.

<Exhaust Unit>

The exhaust unit 70 is a unit that exhausts the air in the printing apparatus 5 outside the apparatus. The printing apparatus 5 according to this embodiment includes the first drying promotion unit 40 and the second drying promotion unit 50, which raise the temperature in the apparatus. In addition, these units operate to evaporate moisture of ink. When continuously printing on a number of sheets, the humidity in the apparatus may rise. A high humidity curves the sheet. The conveyance distance of the sheet from the second drying promotion unit 50 to the opening 5*g* is relatively long, and the sheet is conveyed within the upper space SP2 where water vapor is readily retained. In the space SP2, the sheet may be exposed to a high-humidity atmosphere. The humidity in the apparatus can be lowered when the exhaust unit 70 exhausts the air in the space SP2 outside the apparatus.

Figure 4:
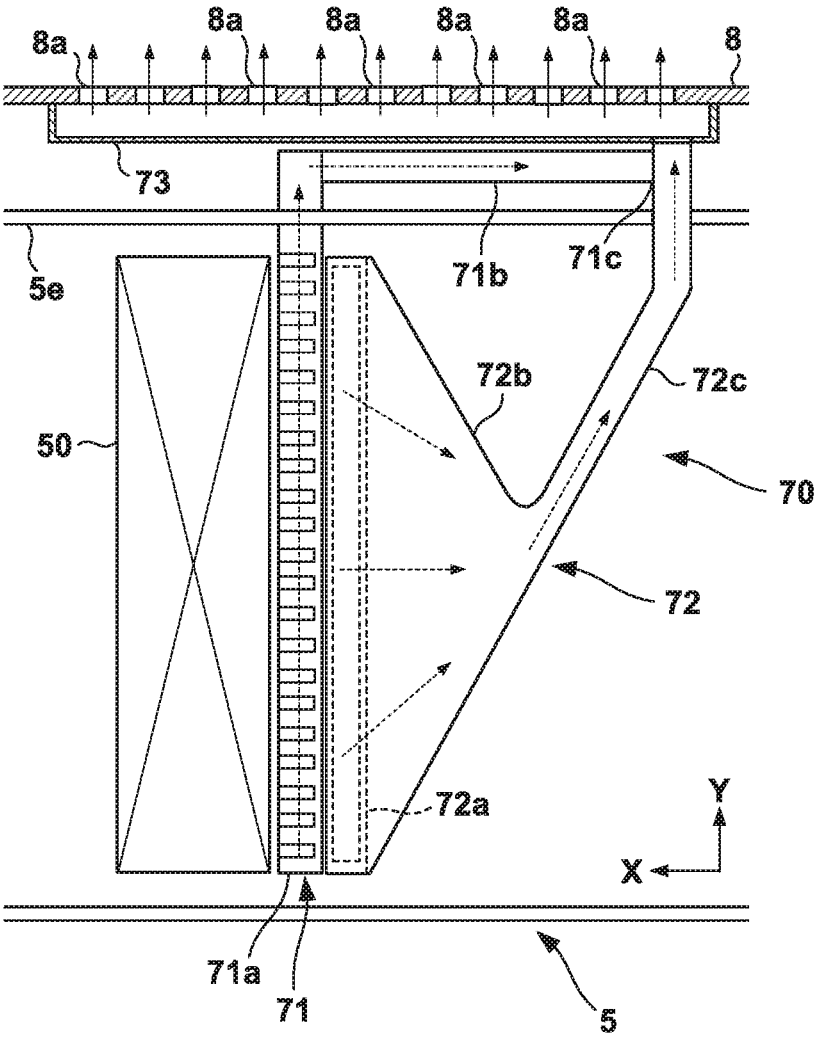
FIG. 4 is an explanatory view of an exhaust unit.

The exhaust unit 70 according to this embodiment has a structure that naturally exhausts the air in the space SP2 by a plurality of exhaust ducts 71 to 73. However, the exhaust unit 70 may forcibly exhaust the air in the apparatus by a fan or the like. The structure of the exhaust unit 70 will be described with reference to FIGS. 2 to 4. FIG. 4 is a plan view showing the periphery of the exhaust unit 70, and does not illustrate the upper wall portion 5*b*.

The exhaust duct 71 is a tube member including an extended portion 71*a* extended in the Y direction and an extended portion 71*b* extended from the far end portion in the Y direction of the extended portion 71*a* to the right side in the X direction. The extended portion 71*a* is extended at a position lower than the main path RT2 near a sheet discharge position in the second drying promotion unit 50. The extended portion 71*a* is an air intake portion in which a plurality of slits serving as air intake ports are formed in the upper left portion and the bottom portion. For example, air warmed by the second drying promotion unit 50 can be introduced from the slit in the upper left portion, and warm air blown from the blowing holes N of the first drying promotion unit 40 can be introduced from the slit in the bottom portion. The extended portion 71*a* is extended across the back wall portion 5*e*, and the far end portion in the Y direction of the extended portion 71*a* and the extended portion 71*b* are located outside (on the far side in the Y direction of) the space SP2. Note that the extended portion 71*a* may be extended at a position above the main path RT2.

The exhaust duct 72 is a tube member including an extended portion 72*a* extended in the Y direction, a collecting portion 72*b* extending rightward from the extended portion 72*a*, and an extended portion 72*c* extended from the right end portion of the collecting portion 72*b* to the far side in the Y direction. The extended portion 72*a* is extended at a position above the main path RT2 near the sheet discharge position in the second drying promotion unit 50. The bottom portion of the extended portion 72*a* is open to form an air intake port from which, for example, air warmed by the second drying promotion unit 50 or water vapor in the space SP2 is introduced. The extended portion 72*a* protrudes above the upper wall portion 5*b* across the upper wall portion 5*b*.

The collecting portion 72*b* has, in a planar view, a triangular shape which is wide on the side of the extended portion 72*a*, and the overall collecting portion 72*b* is located above the upper wall portion 5*b*. The collecting portion 72*b* collects, to the central portion in the Y direction in the right end portion, the air introduced into the extended portion 72*a*. The collected air flows into the extended portion 72*c*. The overall extended portion 72*c* is also located above the upper wall portion 5*b*, and the extended portion 72*c* is partially bended and extended on the far side of the back wall portion 5*e*. On the far side of the back wall portion 5*e*, the extended portion 71*b* of the exhaust duct 71 is connected to the extended portion 72*c* of the exhaust duct 72, and the internal spaces of these portions communicate with each other. The extended portion 72*c* is connected to the exhaust duct 73.

The exhaust duct 73 is an exhaust member that is extended in the X direction and is open to the far side in the Y direction. The opening of the exhaust duct 73 faces a cover 8 that forms the exterior of the main body apparatus 2 on the back side. In the cover 8, a number of slits (louver) 8*a* are formed, and the air flowing into the exhaust duct 73 is exhausted out of the apparatus from the back side of the main body apparatus 2 through the slits 8*a*.

<Control Unit>

Figure 5:
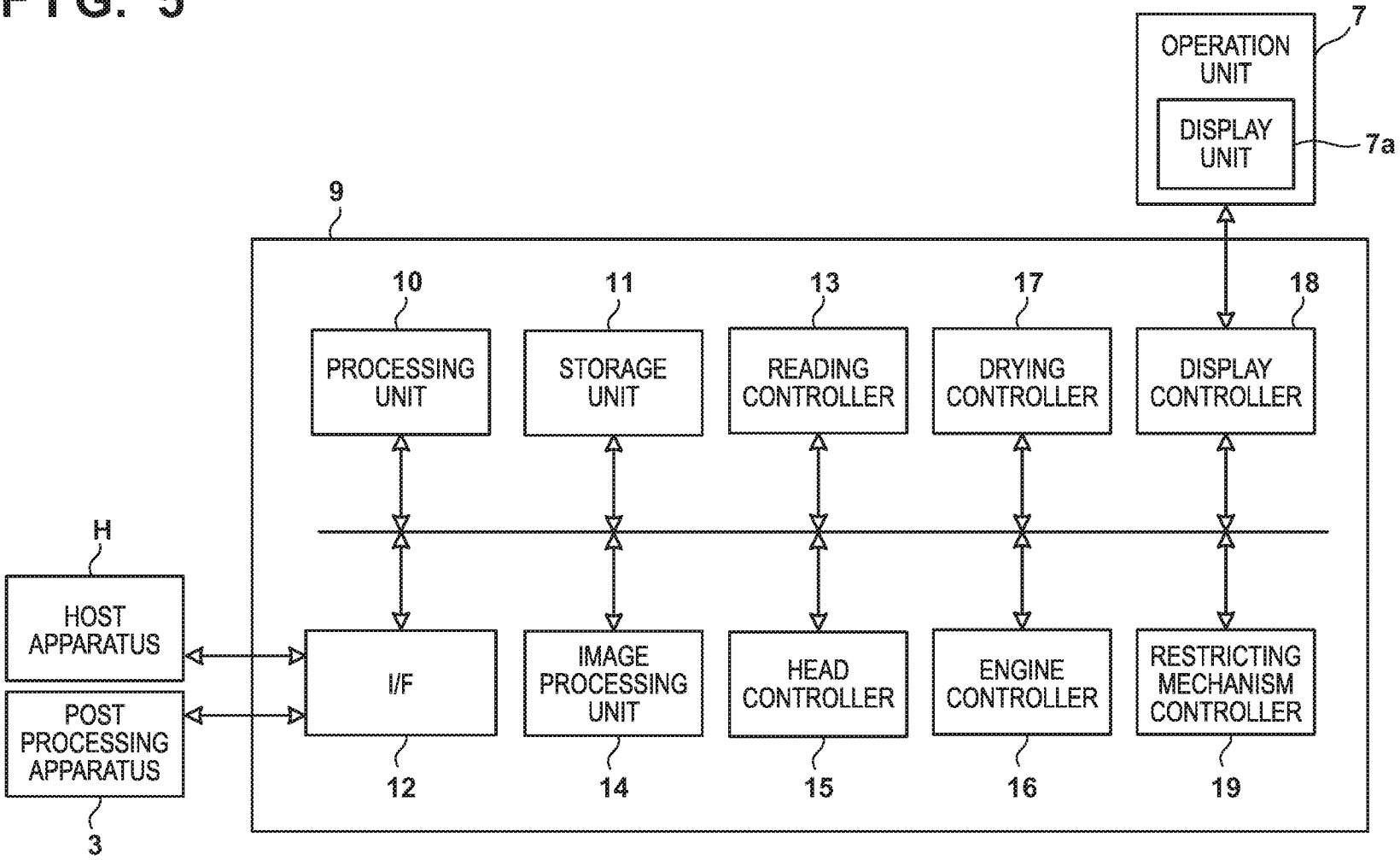
FIG. 5 is a block diagram of a control unit of a main body apparatus.

The control system of the main body apparatus 2 will be described. FIG. 5 is a block diagram of a control unit 9 of the main body apparatus 2. The control unit 9 includes a processing unit 10, a storage unit 11, a reading controller 13, an image processing unit 14, a head controller 15, an engine controller 16, a drying controller 17, a display controller 18, and a restricting mechanism controller 19. The processing unit 10 is a processor represented by a CPU (Central Processing Unit), and comprehensively controls the operations of the units of the main body apparatus 2. The storage unit 11 is, for example, a storage device such as a ROM or a RAM. The storage unit 11 stores a program to be executed by the processing unit 10, and permanent data (for example, data concerning a sheet type stored in each cassette 6*a*) necessary for various operations of the main body apparatus 2. The storage unit 11 serves as a work area of the processing unit 10 or a temporary storage area of various reception data to store various setting data.

The reading controller 13 controls the reading apparatus 4. The image processing unit 14 performs image processing of image data to be processed by the main body apparatus 2. The color space (for example, YCbCr) of input image data is converted into a standard RGB color space (for example, sRGB). Print data obtained by these image processes is stored in the storage unit 11. The head controller 15 controls driving of the printing unit 30 in accordance with the print data based on a control command received from the processing unit 10. For example, the engine controller 16 controls conveyance of a sheet. The drying controller 17 controls driving of the first drying promotion unit 40 and the second drying promotion unit 50. The display controller 18 controls display of information by the display unit 7*a*. The restricting mechanism controller 19 controls the restricting mechanism 80. Each of these controllers includes a processor such as a CPU, a storage device such as a RAM or a ROM, and an interface with an external device.

An I/O 12 is an interface (I/F) for connecting the control unit 9 to a host apparatus H and the post processing apparatus 3, and is a local I/F or a network I/F. The host apparatus H is an apparatus serving as a supply source of image data for causing the printing apparatus 5 to perform a printing operation. The host apparatus H may be a general-purpose or dedicated computer, or a dedicated image apparatus including an image reader, such as image capture, a digital camera, or a photo storage.

Operation Example

An example of the printing operation of the printing apparatus 5 under the control of the control unit 9 will be described with reference to FIGS. 6 to 9. First, an operation when printing an image on one surface of a sheet will be described with reference to FIGS. 6 and 7. When printing an image on one surface of a sheet, the path switching units 25 and 26 are set at the positions (the positions indicated by solid lines in FIG. 3) for one-sided print. The heating elements 43 of the first drying promotion unit 40 and the heating element 54 of the second drying promotion unit 50 are maintained in advance at a predetermined temperature.

Figure 6:
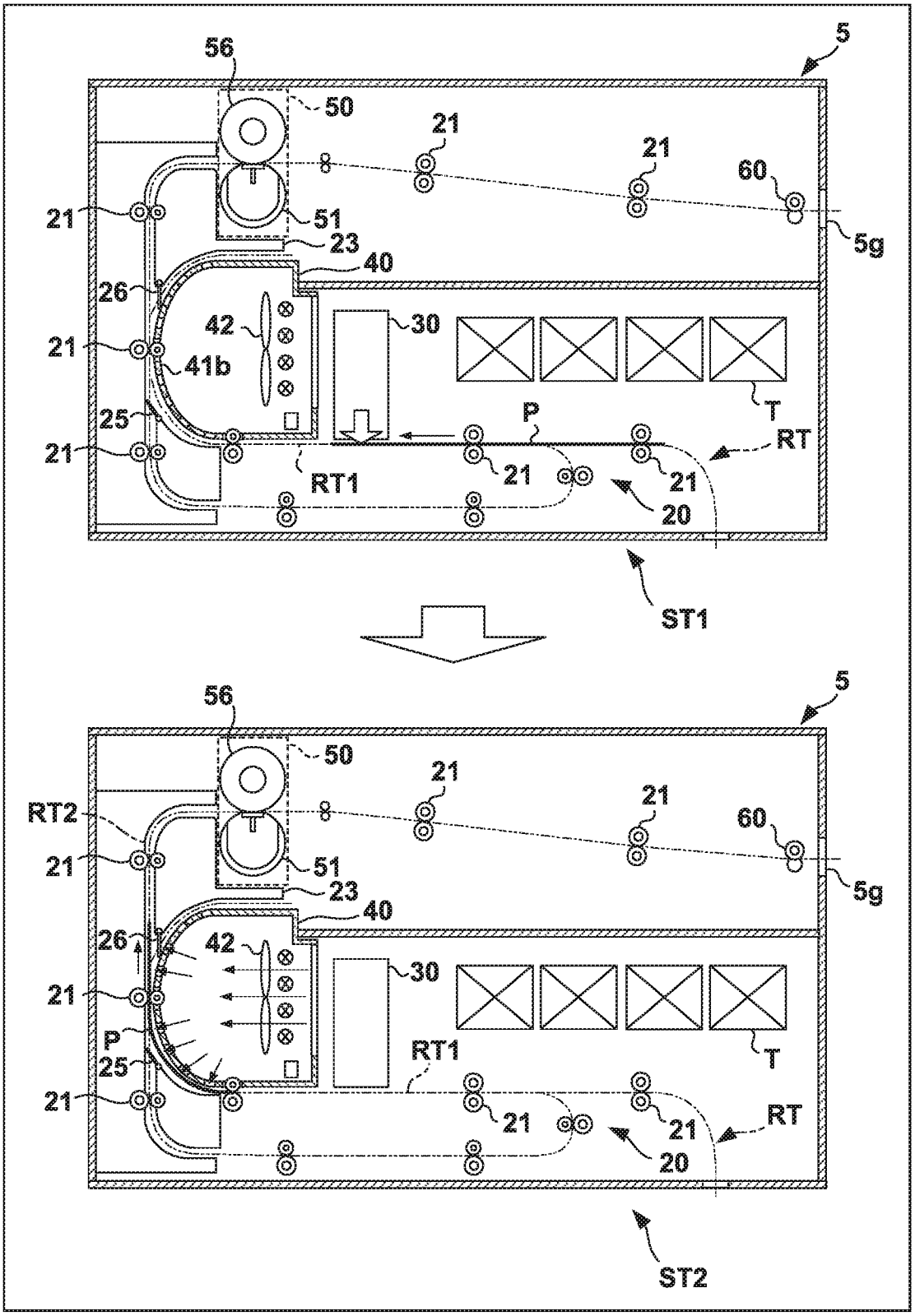
FIG. 6 is an explanatory view of the operation of the printing apparatus shown in FIG. 2.

A state ST1 shown in FIG. 6 indicates a state in which a sheet P fed from the feeding apparatus 6 has been conveyed by the conveyance unit 20 to the printing unit 30 on the main path RT1, and printing by the printing unit 30 has started. The printing unit 30 prints an image by discharging ink to the sheet P as indicated by an arrow. The sheet P is conveyed toward the first drying promotion unit 40. The first drying promotion unit 40 starts to operate, and blows warm air to the conveyed sheet P, as indicated by a state ST2 shown in FIG. 6. The warm air promotes drying of the sheet P wet with ink.

The sheet P is further conveyed toward the second drying promotion unit 50 on the main path RT2. The second drying promotion unit 50 starts to operate, the roller 56 rotates, as indicated by a state ST3 shown in FIG. 7, and the sheet P is heated by the heater 51 while being conveyed. Drying of the sheet P is further promoted.

Figure 7:
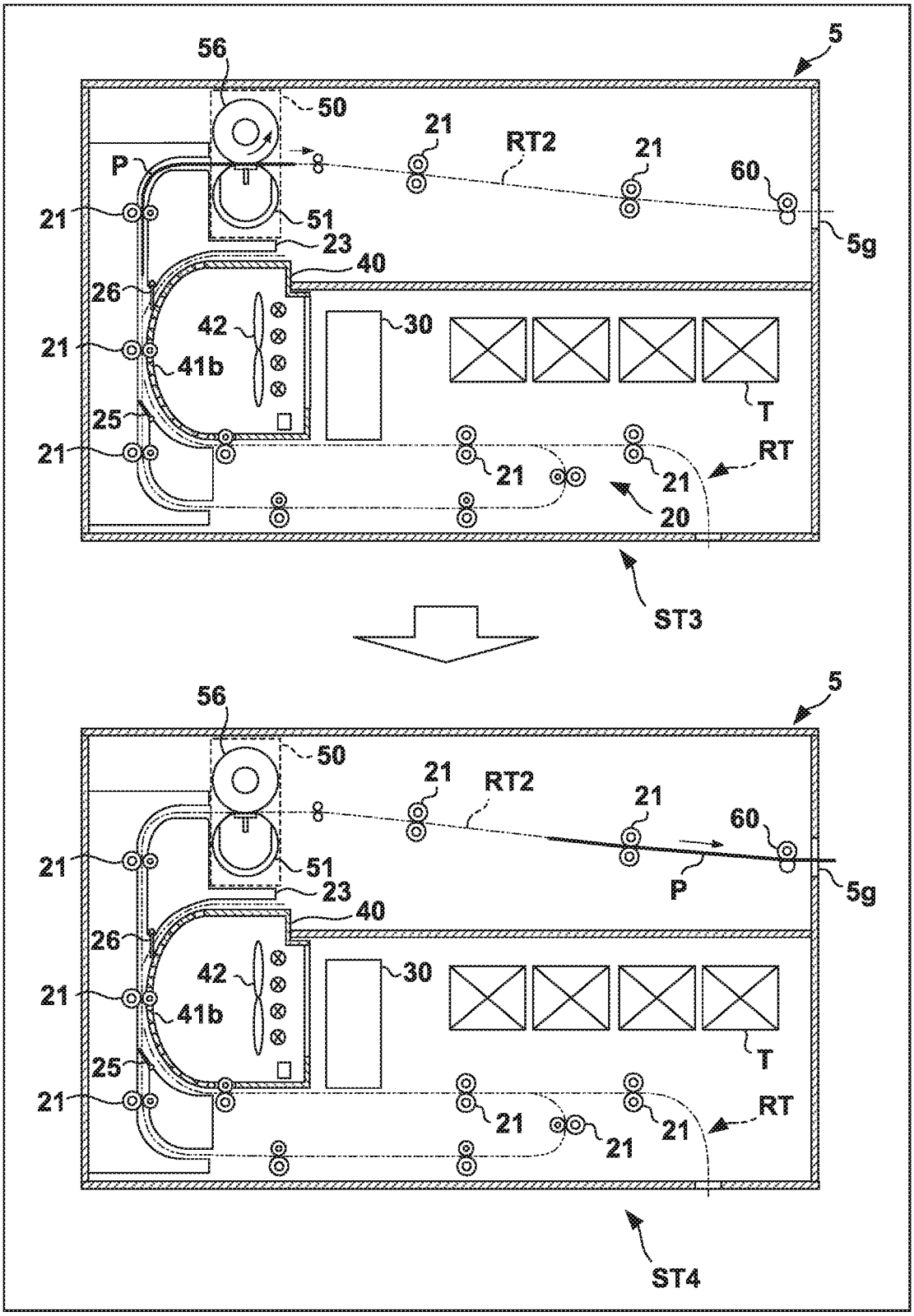
FIG. 7 is an explanatory view of the operation of the printing apparatus shown in FIG. 2.

As indicated by a state ST4 shown in FIG. 7, the sheet P is further conveyed toward the correction unit 60 on the main path RT2. The correction unit 60 starts to operate, and the sheet P is discharged from the opening 5*g* to the post processing apparatus 3 while the curl of the sheet P is corrected.

Figure 8:
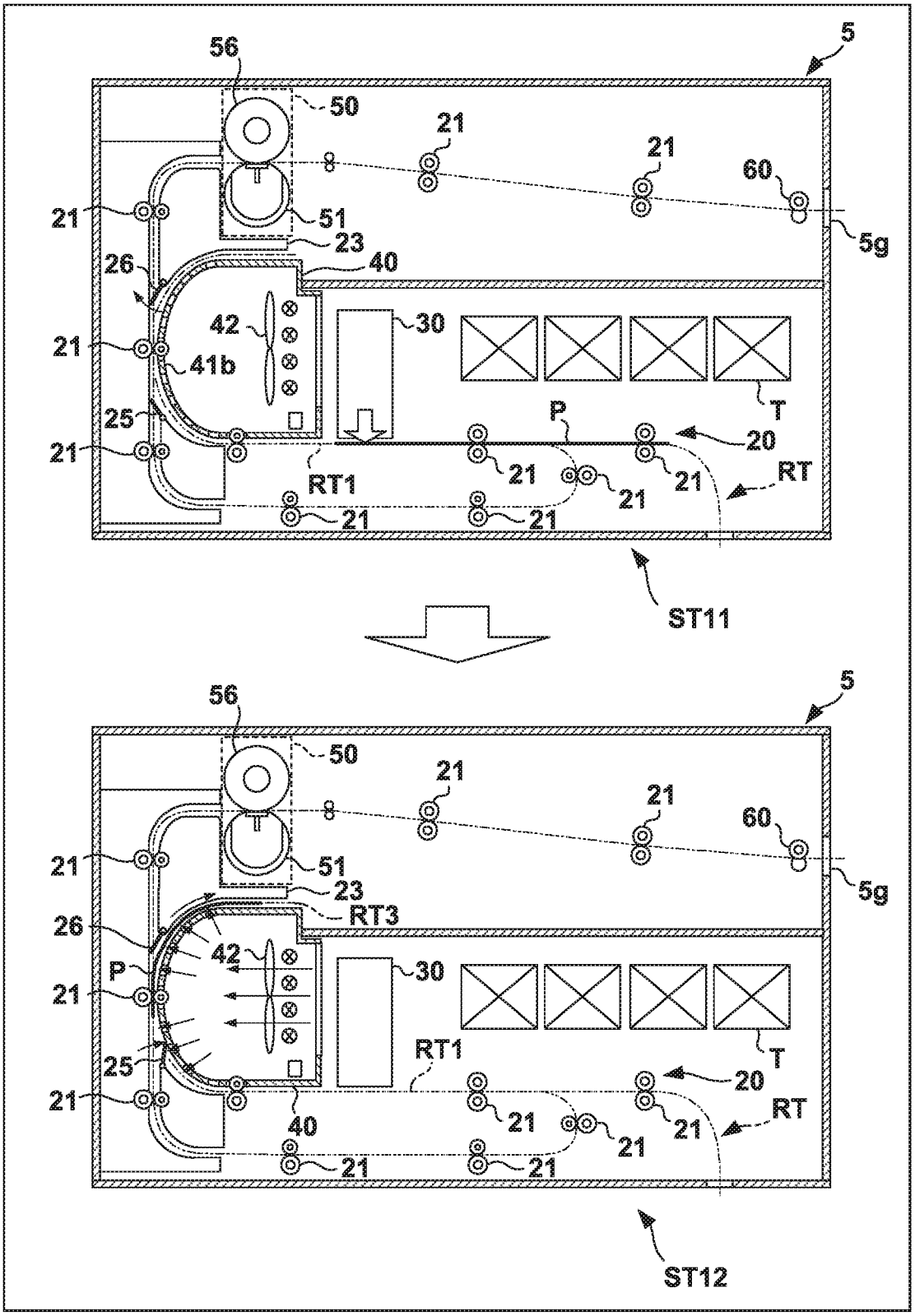
FIG. 8 is an explanatory view of the operation of the printing apparatus shown in FIG. 2.

An operation when printing images on both surfaces of a sheet will be described next with reference to FIGS. 8 and 9. A state ST11 shown in FIG. 8 indicates a state in which the sheet P fed from the feeding apparatus 6 has been conveyed by the conveyance unit 20 to the printing unit 30 on the main path RT1, and the printing unit 30 has started printing. The printing unit 30 prints an image by discharging ink to the front surface of the sheet P, as indicated by an arrow. The path switching unit 26 is set at the position (the position indicated by the broken line in FIG. 3) for double-sided print.

The sheet P is conveyed toward the first drying promotion unit 40. The first drying promotion unit 40 starts to operate, and blows warm air to the conveyed sheet P, as indicated by a state ST12 shown in FIG. 8. The warm air promotes drying of the sheet P wet with ink. The path switching unit 26 guides the sheet P not to be conveyed to the second drying promotion unit 50 but to be conveyed to the switch-back path RT3. When the trailing edge of the sheet P passes through the position of the path switching unit 25, the path switching unit 25 is set at the position for double-sided print. Subsequently, the conveyance unit 20 conveys the sheet P in a reverse direction on the switch-back path RT3 (switch-back conveyance).

Figure 9:
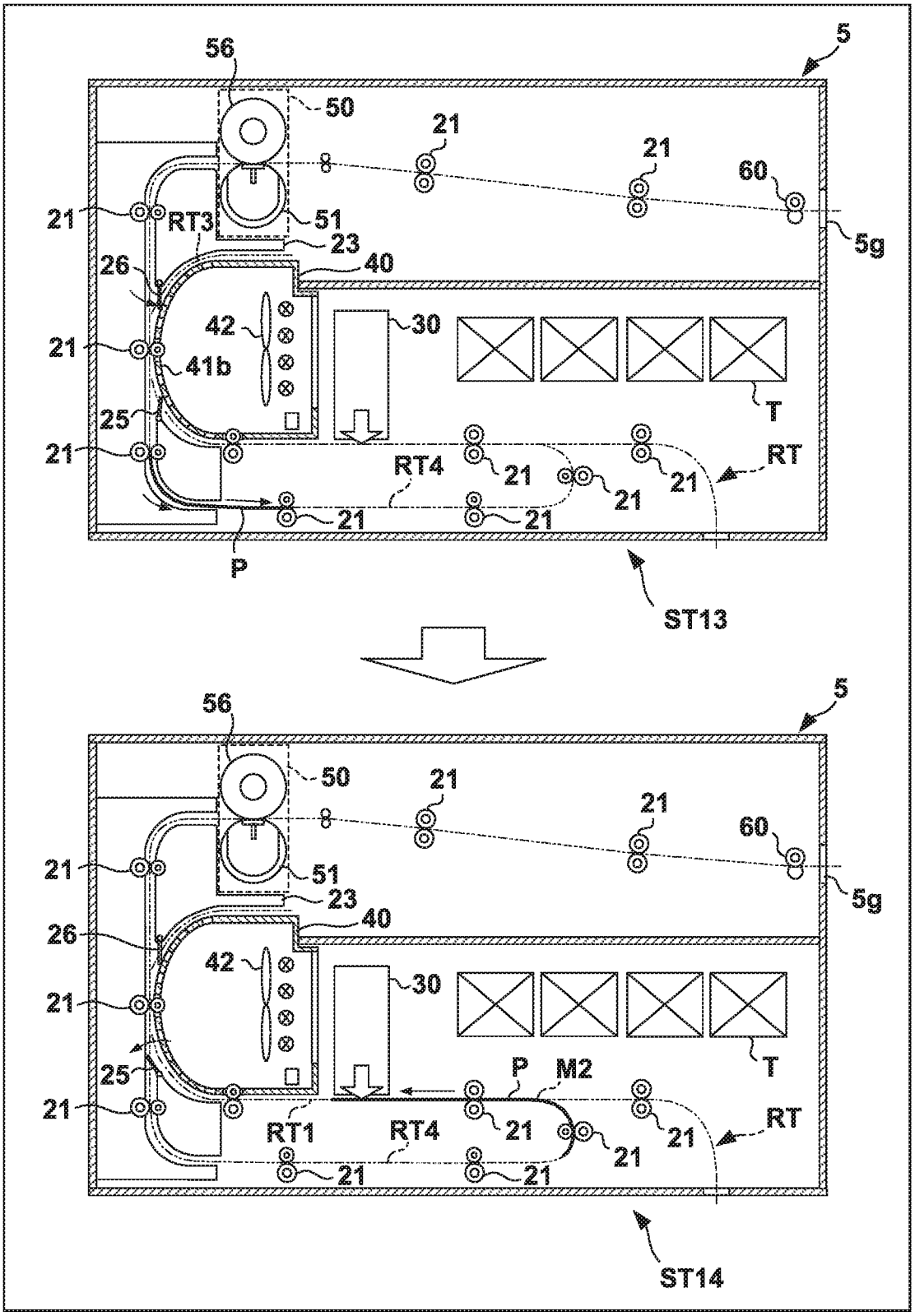
FIG. 9 is an explanatory view of the operation of the printing apparatus shown in FIG. 2.

The path switching unit 25 guides the sheet P to be conveyed to the inverting path RT4, as indicated by a state ST13 shown in FIG. 9. Then, the sheet P is returned to the main path RT1, as indicated by a state ST14 shown in FIG. 9. The path switching unit 25 is set at the position (the position indicated by the solid line in FIG. 3) for one-sided print. The printing unit 30 prints an image by discharging ink to the back surface of the sheet P, as indicated by an arrow. Operations after that are the same as those in the states ST2 to ST4 for one-sided print.

<Arrangement of Cover Member>

Figure 10A:
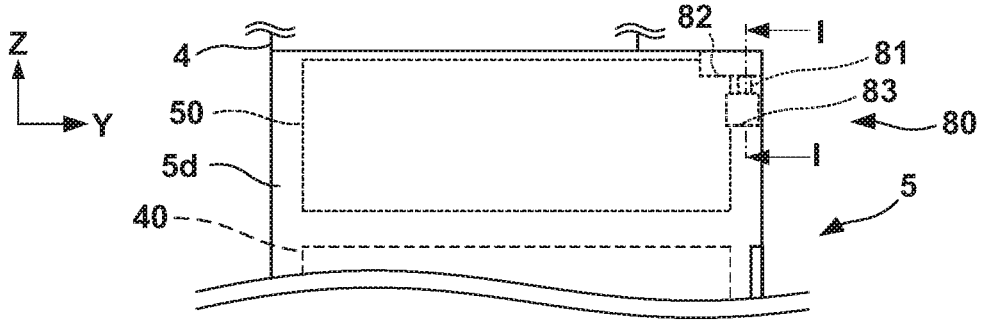
FIG. 10A is a schematic view of a cover member and a restricting mechanism in a closed state.
Figure 10B:
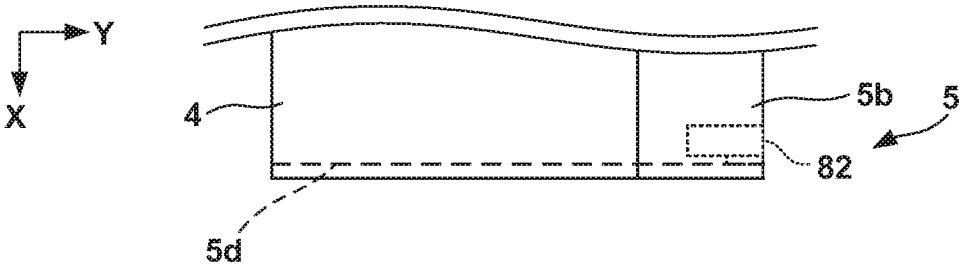
FIG. 10B is a schematic view of the cover member and the restricting mechanism in the closed state.
Figure 10C:
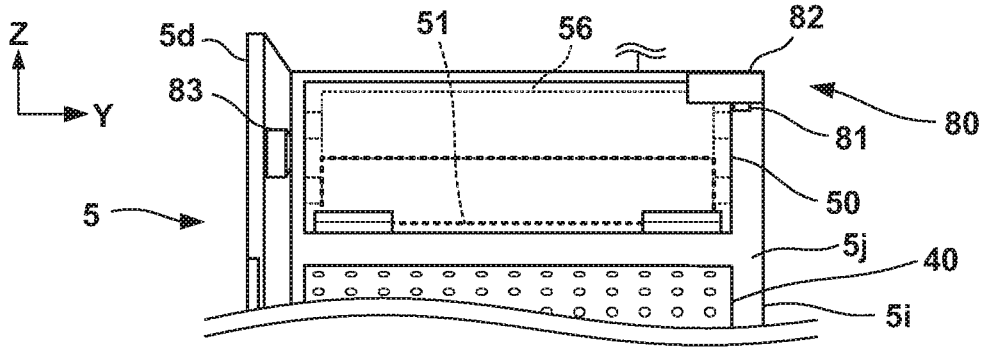
FIG. 10C is a schematic view of the cover member and the restricting mechanism in an open state.
Figure 10D:
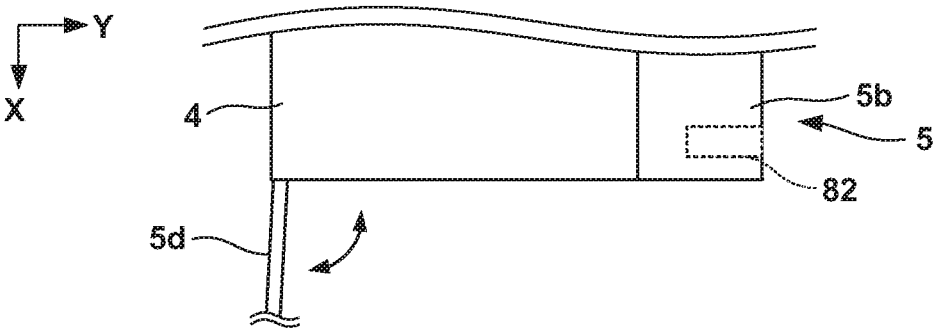
FIG. 10D is a schematic view of the cover member and the restricting mechanism in the open state.

FIG. 10A is a schematic view showing the arrangement of the cover member 5*d* and the restricting mechanism 80, and shows a closed state in which the cover member 5*d* is closed. FIG. 10B is a schematic view showing the arrangement of the cover member 5*d* and the restricting mechanism 80, and shows the printing apparatus 5 in the closed state when viewed from above. FIG. 10C is a schematic view showing the arrangement of the cover member 5*d* and the restricting mechanism 80, and shows an open state in which the cover member 5*d* is opened. FIG. 10D is a schematic view showing the arrangement of the cover member 5*d* and the restricting mechanism 80, and shows the printing apparatus 5 in the open state when viewed from above. Each of FIGS. 10A and 10C is a view of the printing apparatus 5 when viewed from the left side in FIG. 1. Note that in FIGS. 10A to 10D, some components such as the guide members 22 to 24 are not illustrated in order to make the drawings easy to see.

In this embodiment, the left side of the cover member 5*d* is pivotably supported by the housing 5*i* when viewed from the front, and formed to be opened to the left with respect to the housing 5*i*. When the cover member 5*d* is opened, the second drying promotion unit 50 is exposed through the opening 5*j*. Therefore, the second drying promotion unit 50 can be removed from the housing 5*i* via the opening 5*j*.

Note that in this embodiment, although omitted in FIGS. 10C and 10D, the guide members 23 and 24 are provided such that the second drying promotion unit 50 can be exposed when viewed from the opening 5*j* side at the time of opening the cover member 5*d*. For example, the guide member 24 may be supported by the cover member 5*d*. Alternatively, for example, the guide member 23 may be supported so as to be pivotable with respect to the housing 5*i*, and the entire second drying promotion unit 50 may be exposed by pivoting the guide member 23. With this arrangement, it is possible to perform jam clearance near the second drying promotion unit 50, and attach/detach the second drying promotion unit 50.

The mode of opening/closing the cover member 5*d* can be appropriately designed. For example, the cover member 5*d* may be opened to the right, opened vertically, or the like. Further, the cover member 5*d* may be removable from the housing 5*i*, or may be a slide type.

<Arrangement of Restricting Mechanism>

Figure 11A:
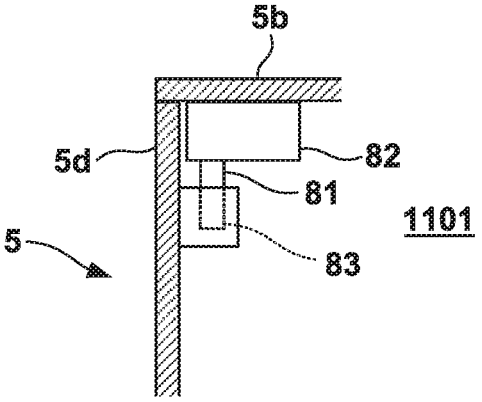
FIG. 11A is a sectional view taken along a line I-I in FIG. 10A.
Figure 11B:
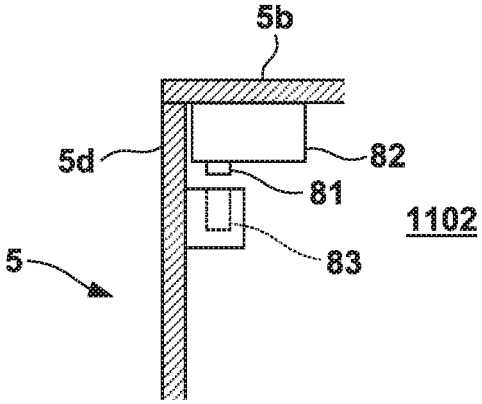
FIG. 11B is a sectional view showing a state in which a displacement member is set in a release position.

FIG. 11A is a sectional view taken along a line I-I in FIG. 10A, and shows a state in which a displacement member 81 is set in a restriction position, and FIG. 11B is a sectional view showing a state in which the displacement member 81 is set in a release position. The printing apparatus 5 includes the restricting mechanism 80 for restricting the opening operation of the cover member 5*d*, that is, for locking the cover member 5 in the closed state. In this embodiment, the restricting mechanism 80 includes the displacement member 81, an actuator 82 that drives the displacement member 81, and an engaging portion 83 that engages with the displacement member 81.

The displacement member 81 is a member provided on the housing 5*i* side and displaceable between the restriction position for restricting the opening operation of the cover member 5*d* and the release position for releasing the restriction. In this embodiment, the displacement member 81 has a rod-like shape extending vertically, and is vertically displaced between the restriction position and the release position.

The actuator 82 is provided on the housing 5*i* side. For example, the actuator 82 is an electric motor. As an example, the restricting mechanism 80 includes a rack and pinion mechanism, and this converts the rotational movement of the electric motor into the translational movement of the displacement member 81.

Another known mechanical restricting mechanism can also be employed as the restricting mechanism 80. Further, not only the mechanical mechanism but also an electromagnet or the like may be used to switch the restricting state and the release state. However, in this embodiment, by restricting the opening operation with the mechanical component, it is possible to more reliably restrict the pivot movement of the cover member 5*d*.

The engaging portion 83 engages with the displacement member 81 in a state in which the displacement member 81 is set in the restriction position, thereby restricting the opening operation of the cover member 5*d*. In this embodiment, the engaging portion 83 is provided on the cover member 5*d* side and, for example, is a concave portion corresponding to the shape of the displacement member 81.

When the displacement member 81 is set in the restriction position (a position 1101) as shown in FIG. 11A, the opening operation of the cover member 5*d* is restricted in the closed state in which the cover member 5*d* is kept closed (FIG. 10A). On the other hand, when the displacement member 81 is set in the release position (a position 1102) as shown in FIG. 11B, the restriction of the opening operation of the cover member 5*d* is released, so that the cover member 5*d* can pivot with respect to the housing 5*i* (FIG. 10C).

PROCESSING EXAMPLES OF RESTRICTING MECHANISM CONTROLLER

When jam clearance occurs or when the second drying promotion unit 50 is to be inserted or removed, the user performs the operation while opening the cover member 5*d*, but this causes the second drying promotion unit 50 and its surrounding members having reached a high temperature after operation to be exposed. Therefore, in this embodiment, the restricting mechanism controller 19 controls the restricting mechanism 80 based on the temperature condition of the second drying promotion unit 50. With this operation, it is possible to suppress exposure of the second drying promotion unit 50 and its surrounding members in a high temperature state. Processing examples of the restricting mechanism controller 19 will be described below.

Processing Example 1

Figure 12B:
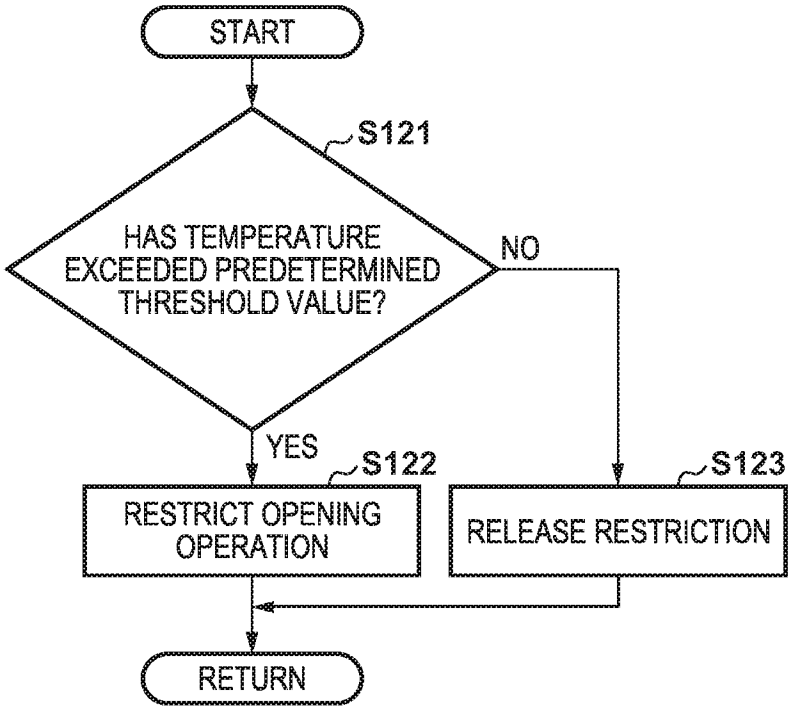
FIG. 12B is a flowchart illustrating the example of the processing executed by the restricting mechanism controller.
Figure 12A:
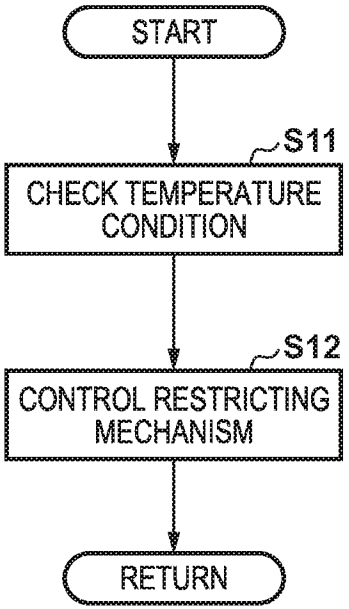
FIG. 12A is a flowchart illustrating an example of processing executed by a restricting mechanism controller.

FIG. 12A is a flowchart illustrating an example of processing executed by the restricting mechanism controller 19. FIG. 12B is a flowchart illustrating an example of processing in step S12 of FIG. 12A. These flowcharts are implemented by, for example, the CPU loading a program stored in the ROM into the RAM and executing it in the restricting mechanism controller 19.

In step S11, the restricting mechanism controller 19 checks the temperature condition of the second drying promotion unit 50. In this embodiment, the restricting mechanism controller 19 acquires the temperature of the second drying promotion unit 50 from a detection result of the temperature sensor 55. However, the restricting mechanism controller 19 may check the temperature condition of the second drying promotion unit 50 from its output, heating time, control condition of the warm-up control at startup, and the like of the second drying promotion unit 50. That is, the temperature condition is not limited to the direct temperature information acquired from the temperature sensor or the like, but may be indirect temperature information estimated from another information.

In step S12, the restricting mechanism controller 19 controls the restricting mechanism 80 based on the temperature condition acquired in step S11, and the flowchart is terminated. An example of processing in step S12 will be described with reference to FIG. 12B.

In step S121, the restricting mechanism controller 19 determines whether the temperature as the temperature condition acquired in step S11 exceeds a predetermined threshold value. If the temperature exceeds the predetermined threshold value, the process advances to step S122; otherwise, the process advances to step S123. The threshold temperature may be set within a range of, for example, 50° to 60°. More specifically, the threshold temperature may be, for example, 55°. Note that when the restricting mechanism controller 19 acquires, as the temperature condition, information such as the output, heating time, control condition of the warm-up control at startup of the second drying promotion unit 50 in step S11, the process may advance to step S122 if the acquired information satisfies a predetermined condition for restricting the opening operation.

In step S122, the restricting mechanism controller 19 restricts the opening operation of the cover member 5*d*. That is, the restricting mechanism controller 19 controls the actuator 82 to displace the displacement member 81 from the release position to the restriction position. Thus, the opening operation of the cover member 5*d* is restricted. Note that if Yes in step S121, the restricting mechanism controller 19 may check the current position of the displacement member 81 before executing the processing in step S122, and if the displacement member 81 is already in the restriction position, the processing in step S122 may be omitted.

In step S123, the restricting mechanism controller 19 releases the restriction of the opening operation of the cover member 5*d*. That is, the restricting mechanism controller 19 controls the actuator 82 to displace the displacement member 81 from the restriction position to the release position. Thus, the restriction of the opening operation of the cover member 5*d* is released. Note that if No in step S121, the restricting mechanism controller 19 may check the current position of the displacement member 81 before executing the processing in step S123, and if the displacement member 81 is already in the release position, the processing in step S123 may be omitted.

According to this processing example, the opening operation of the cover member 5*d* is restricted in accordance with the temperature condition of the second drying promotion unit 50, so that it is possible to suppress exposure of the heading device in a high temperature state.

Processing Example 2

Figure 13A:
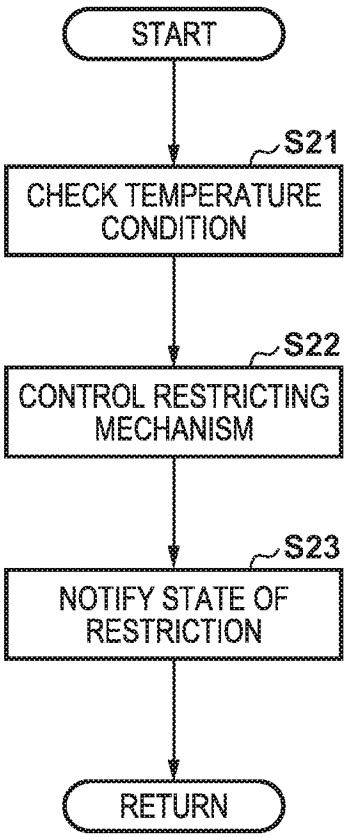
FIG. 13A is a flowchart illustrating another example of the processing executed by the restricting mechanism controller.
Figure 13B:
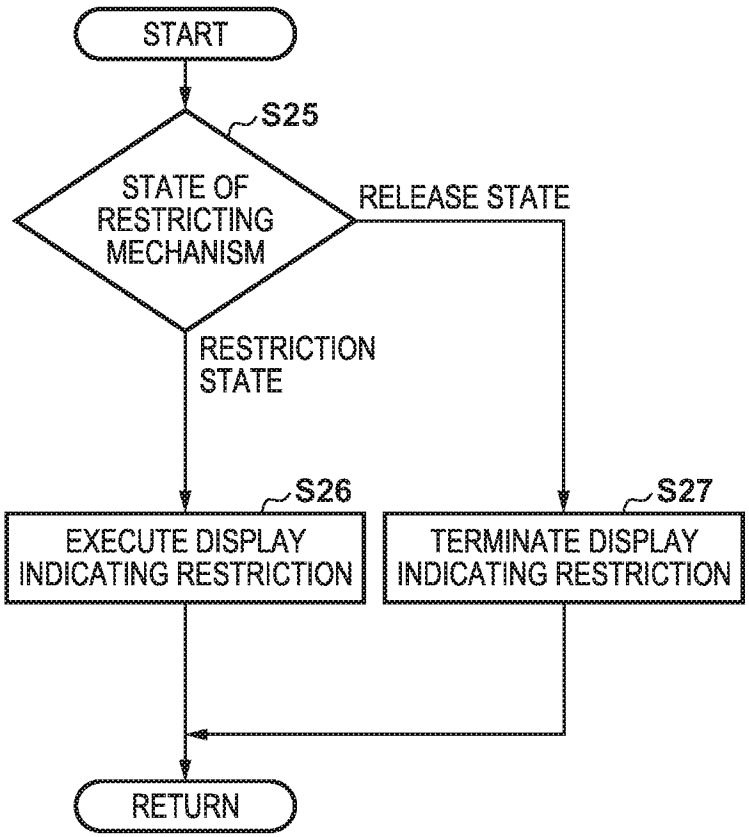
FIG. 13B is a flowchart illustrating an example of processing executed by a display controller.
Figure 13C:
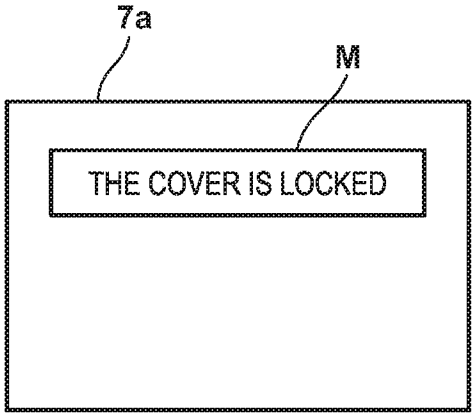
FIG. 13C is an example of display by the display unit.

FIG. 13A is a flowchart illustrating an example of processing executed by the restricting mechanism controller 19, and FIG. 13B is a flowchart illustrating an example of processing executed by the display controller 18. This processing example shows a processing example in a case of, if the opening operation of the cover member 5*d* is restricted, displaying information about the restriction on the display unit 7*a* included in the operation unit 7. FIG. 13C is a view showing an example of display by the display unit 7*a*.

Steps S21 and S22 are processing operations similar to those in steps S11 and S12, respectively. In step S23, the restricting mechanism controller 19 notifies the display controller 18 of the state of restriction of the restricting mechanism 80, and terminates the processing. In this embodiment, the restricting mechanism controller 19 notifies the display controller 18 whether the restricting mechanism 80 is in a restricting state or in a release state.

Processing by the display controller 18 will be described with reference to FIG. 13B. In step S25, the display controller 18 checks the state of the restricting mechanism 80 based on the notification from the restricting mechanism controller 19 in step S23. If the restricting mechanism 80 is in the restricting state, that is, if the displacement member 81 is set in the restriction position, the display controller 18 advances to step S26. On the other hand, if the restricting mechanism 80 is in the release state, that is, if the displacement member 81 is set in the release position, the display controller 18 advances to step S27.

In step S26, the display controller 18 displays, on the display unit 7*a*, information indicating that the opening operation of the cover member 5*d* is restricted by the restricting mechanism 80. FIG. 13C shows an example of display on the display unit 7*a*. As an example, the display controller 18 displays a message M such as "the cover is locked" on the display unit 7*a*. Thus, the information indicating that the opening operation is restricted is informed to the user. Note that if it is confirmed in step S25 that the restricting mechanism 80 is in the restricting state, the display controller 18 may check the current display condition of the display unit 7*a* before advancing to the processing in step S26, and if the message is already being displayed, the processing in step S26 may be omitted. Alternatively, the display controller 18 may check the current display condition of the display unit 7*a* before advancing to the processing in step S26, and if the message is already being displayed, it may execute processing for continuing the display of the message.

In step S27, the display controller 18 terminates the display, on the display unit 7*a*, of the information indicating that the opening operation of the cover member 5*d* is restricted by the restricting mechanism 80. Note that if it is confirmed in step S25 that the restricting mechanism 80 is in the release state, the display controller 18 may check the current display condition of the display unit 7*a* before advancing to the processing in step S27, and if the information is not being displayed, the processing in step S27 may be omitted.

According to this processing example, the information indicating that the opening operation of the cover member 5*d* is restricted is displayed, so that the user can more readily recognize the restriction of the opening operation. Therefore, when the user tries to open the cover member 5*d* for jam clearance, replacement of the second drying promotion unit 50, or the like, the user can recognize that the opening operation is restricted, so that the user convenience is improved.

Processing Example 3

Figure 14:
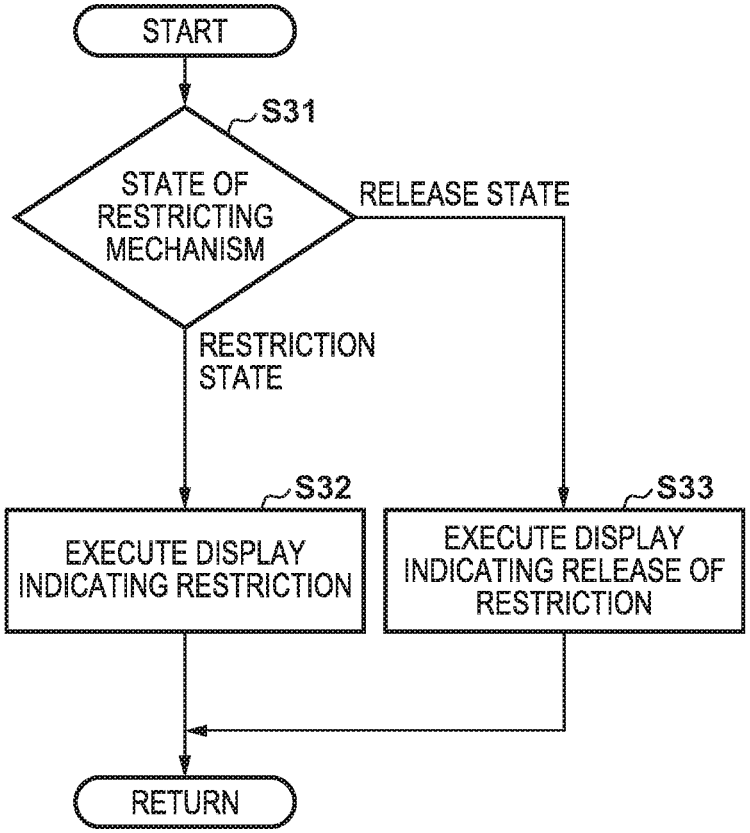
FIG. 14 is a flowchart illustrating another example of the processing executed by the display controller.

FIG. 14 is a flowchart illustrating an example of processing executed by the display controller 18. This processing example shows a processing example in a case of, if the opening operation of the cover member 5*d* is being released, displaying information indicating that the opening operation is not being restricted on the display unit 7*a* of the operation unit 7.

Steps S31 and S32 are processing operations similar to those in steps S25 and S26, respectively. In step S33, the display controller 18 displays, on the display unit 7*a*, information indicating that the opening operation of the cover member 5*d* is being released by the restricting mechanism 80. As an example, the restricting mechanism controller 19 displays a message such as "the cover is unlocked" on the display unit 7*a*. Note that if it is confirmed in step S31 that the restricting mechanism 80 is in the release state, the display controller 18 may check the current display condition of the display unit 7*a* before advancing to the processing in step S33, and if the message is already being displayed, the processing in step S33 may be omitted. Alternatively, the display controller 18 may check the current display condition of the display unit 7*a* before advancing to the processing in step S33, and if the message is already being displayed, it may execute processing for continuing the display of the message.

According to this processing example, the information indicating that the opening operation of the cover member 5*d* is not being restricted is displayed, so that the user can more readily recognize the state of restriction of the cover member 5*d*. Therefore, when the user tries to open the cover member 5*d* for jam clearance, replacement of the second drying promotion unit 50, or the like, the user can recognize the state of restriction of the opening operation of the cover member 5*d*, so that the user convenience is improved.

ARRANGEMENT EXAMPLE OF DRYING PROMOTION UNIT

Arrangement Example 1

Figure 15B:
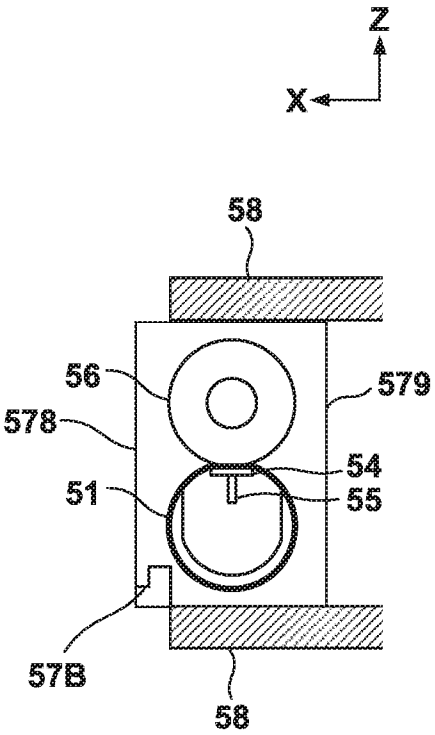
FIG. 15B is a sectional view taken along a line II-II in FIG. 15A.
Figure 15A:
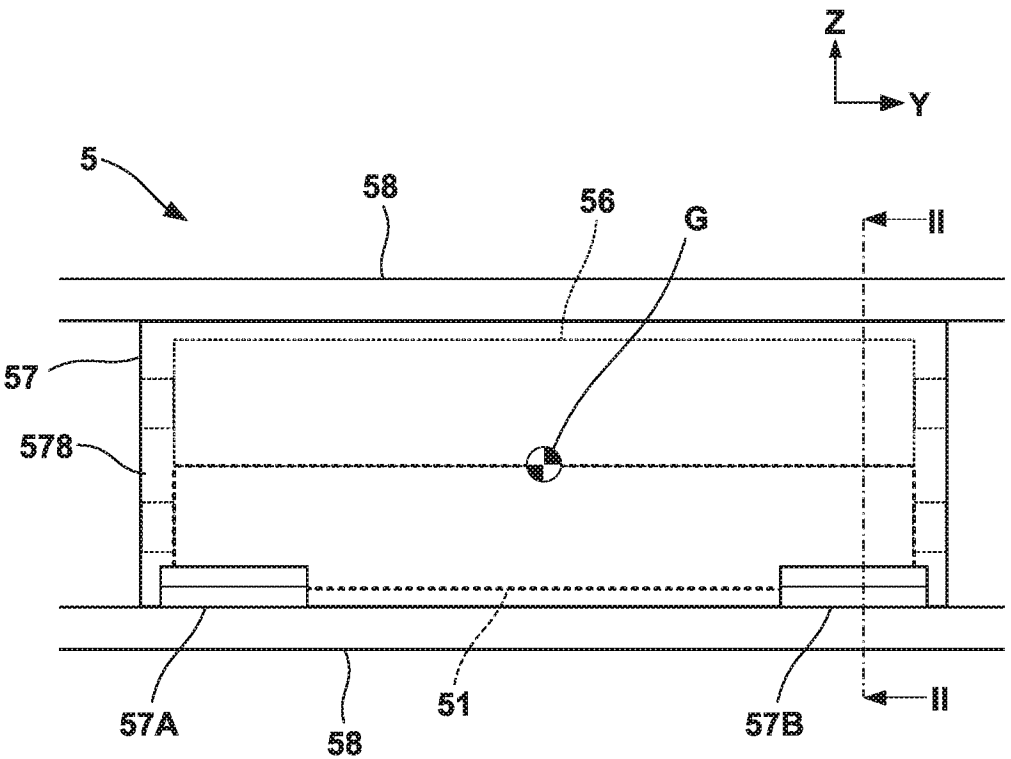
FIG. 15A is a front view showing an arrangement example of a drying promotion unit.

FIG. 15A is a front view showing an arrangement example of the second drying promotion unit 50, and FIG. 15B is a sectional view taken along a line II-II in FIG. 15A. Note that FIG. 15A is a schematic view of the second drying promotion unit 50 when viewed from the opening 5*j* side. In FIG. 15B, for the sake of simplicity, hatching indicating the sectional view is appropriately omitted (this also applies to FIGS. 16B and 17B to be described later).

In this arrangement example, the second drying promotion unit 50 is provided so as to be attachable/detachable to/from attachment portions 58 provided on the housing 5*i* side at the time of attachment. The attachment portion 58 is, for example, a frame member supported by the housing 5*i*. In the example shown in FIG. 15A, the second drying promotion unit 50 is attached to the housing 5*i* so as to be sandwiched between two frame members which are vertically spaced apart from each other.

The second drying promotion unit 50 includes an accommodation portion 57 that accommodates the heater 51 and the roller 56, which are extended in the widthwise direction crossing the conveyance direction of the sheet P, and the like. The accommodation portion 57 is formed by, for example, a resin member or the like so as to cover the heater 51, the roller 56, and the like. In addition, an opening (not shown) serving as the conveyance path of the print medium is provided in each of a front surface 578 and a back surface 579 of the accommodation portion 57.

Further, a plurality of grip portions 57A and 57B spaced apart from each other are provided in the accommodation portion 57. The user can remove the second drying promotion unit 50 from the housing 5*i* by gripping the grip portions 57A and 57B and pulling them out in the X direction. Since the plurality of grip portions (57A and 57B) are provided, the user can grip the second drying promotion unit 50, which is a heavy load, at the plurality of portions, so that the user can more stably attach and detach the second drying promotion unit 50.

The arrangement of the plurality of grip portions 57A and 57B can be appropriately designed. For example, the plurality of grip portions 57A and 57B may be provided with a center of gravity G of the second drying promotion unit 50 therebetween. With this arrangement, the second drying promotion unit 50 is less likely to incline when the user grips the second drying promotion unit 50, so that the user can more stably attach and detach the second drying promotion unit 50. In this embodiment, the plurality of grip portions 57A and 57B are provided on the both end portion sides of the roller 56. Thus, it is possible to more stably attach and detach the second drying promotion unit 50 which is long in the widthwise direction.

Note that the number of the grip portions is not limited to two, and may be three or more. Further, in this embodiment, as shown in FIG. 15B, the grip portions 57A and 57B are concave portions formed in the accommodation portion 57. However, another shape can also be employed as the grip portion. For example, each grip portion may have a collar-like shape protruding from the accommodation portion 57 to the front side (X direction) or the like.

Arrangement Example 2

Figure 16B:
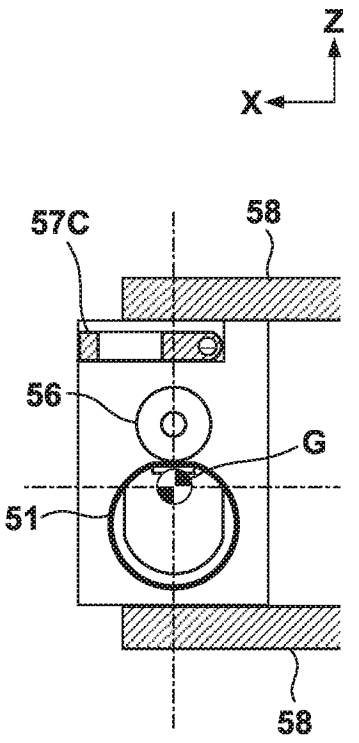
FIG. 16B is a sectional view taken along a line III-III in FIG. 16A.
Figure 16A:
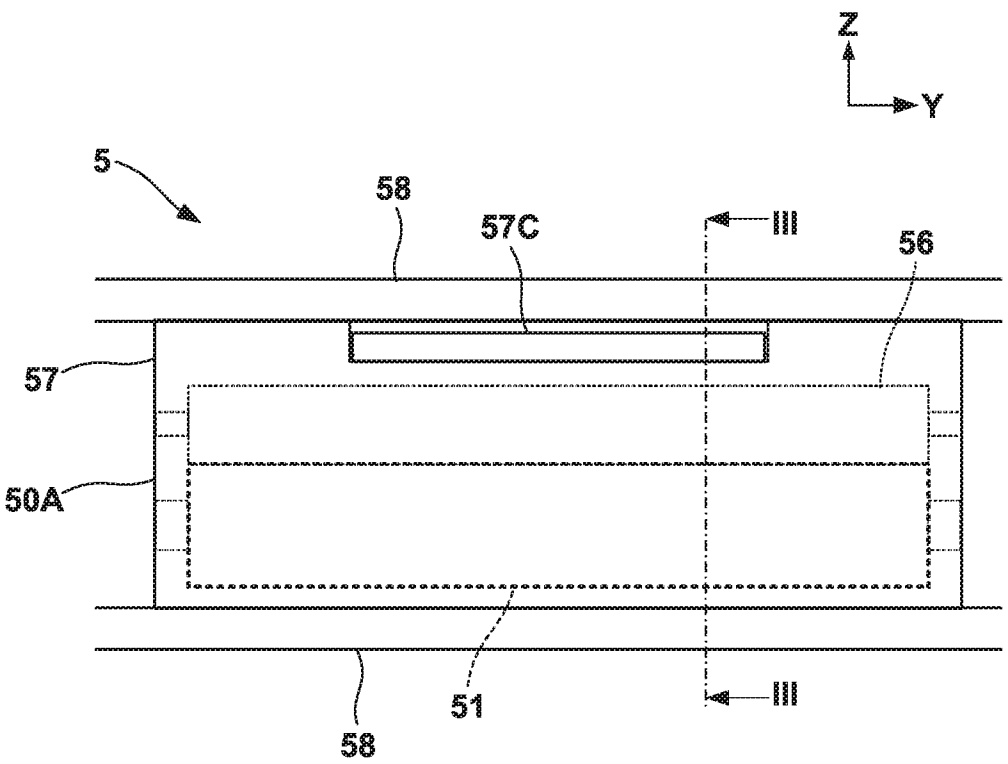
FIG. 16A is a front view showing another arrangement example of the drying promotion unit.
Figure 17B:
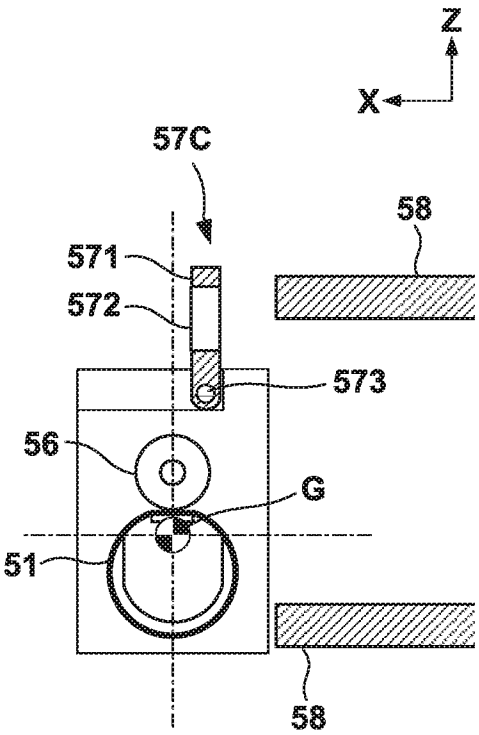
FIG. 17B is a sectional view taken along a line IV-IV in FIG. 17A.
Figure 17A:
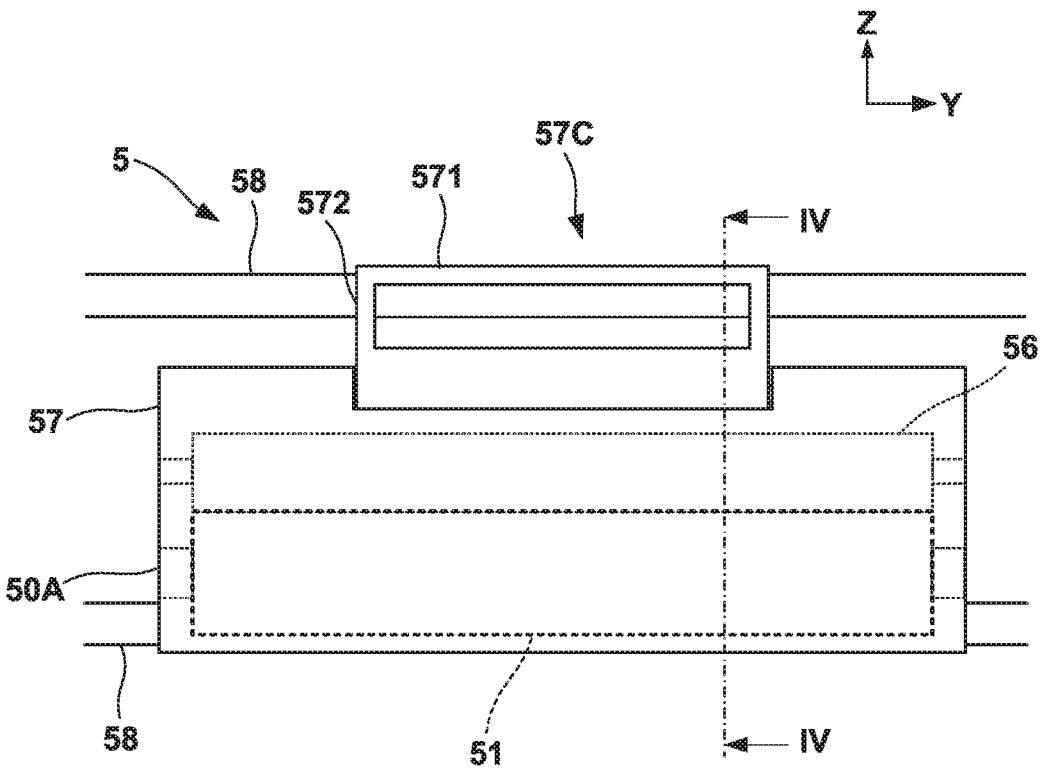
FIG. 17A is a schematic front view showing a case in which a grip portion of the drying promotion unit shown in FIG. 16A is in an extended state.

FIG. 16A is a front view showing another arrangement example of the second drying promotion unit 50, and a schematic view showing a case in which the grip portion is in a retracted state. FIG. 16B is a sectional view taken along a line III-III in FIG. 16A. FIG. 17A is a schematic front view showing a case in which the grip portion of the second drying promotion unit 50 shown in FIG. 16A is in an extended state, and FIG. 17B is a sectional view taken along a line IV-IV in FIG. 17A. Note that components similar to those of the second drying promotion unit 50 in <Arrangement Example 1> have the same reference numerals, and a description thereof will be omitted.

In this arrangement example, the second drying promotion unit 50 is provided with a main body 50A which includes the heater 51, the roller 56, and the accommodation portion 57 that accommodates the heater 51 and the roller 56, and a grip portion 57C which is pivotable with respect to the main body 50A. In this arrangement example, the grip portion 57C pivots between the extended state (FIG. 17A) in which it stands upright with respect to the main body 50A and the retracted state (FIG. 16A) in which it lies down with respect to the main body 50A.

The grip portion 57C is pivotably supported on the upper surface of the accommodation portion 57. Further, the grip portion 57C includes a grip member 571 which is gripped by the user, and connection members 572 each connecting the grip member 571 and a pivot shaft 573. Note that this supporting mode of the grip portion 57C is merely an example, and another supporting mode can also be employed. For example, the grip portion 57C may be pivotably supported at the both side surfaces of the accommodation portion 57.

As shown in FIGS. 16A and 16B, in this arrangement example, the second drying promotion unit 50 is provided such that the grip portion 57C in the retracted state is exposed upon opening the cover member 5*d*. More specifically, the second drying promotion unit 50 is provided such that the grip member 571 of the grip portion 57C is exposed. Thus, the user can grip the grip member 57C and pull out the second drying promotion unit 50. In addition, since the grip member 57C lies down in the retracted state, the second drying promotion unit 50 can be accommodated more compactly.

When the second drying promotion unit 50 is pulled out from the attachment portions 58, the grip portion 57C is pivoted by the weight of the main body 50A, so that the grip portion 57C is set in the extended state (FIG. 17A). Since the grip portion 57C stands upright in the extended state, the user can hang and hold the second drying promotion unit 50.

Further, in this arrangement example, the pivot shaft of the grip portion 57C is provided above the center of gravity G of the main body 50A. In addition, the pivot shaft of the grip portion 57C is provided behind (on the side far from the opening 5*j*) the center of gravity G of the main body 50A in the pull-out direction (X direction). Thus, the inclination of the main body 50A upon being pulled out can be further suppressed.

Note that it is also possible to employ an arrangement in which the grip portions 57A and 57B of arrangement example 1 and the grip portion 57C of this arrangement example are used together.

Arrangement Example 3

Figure 18:
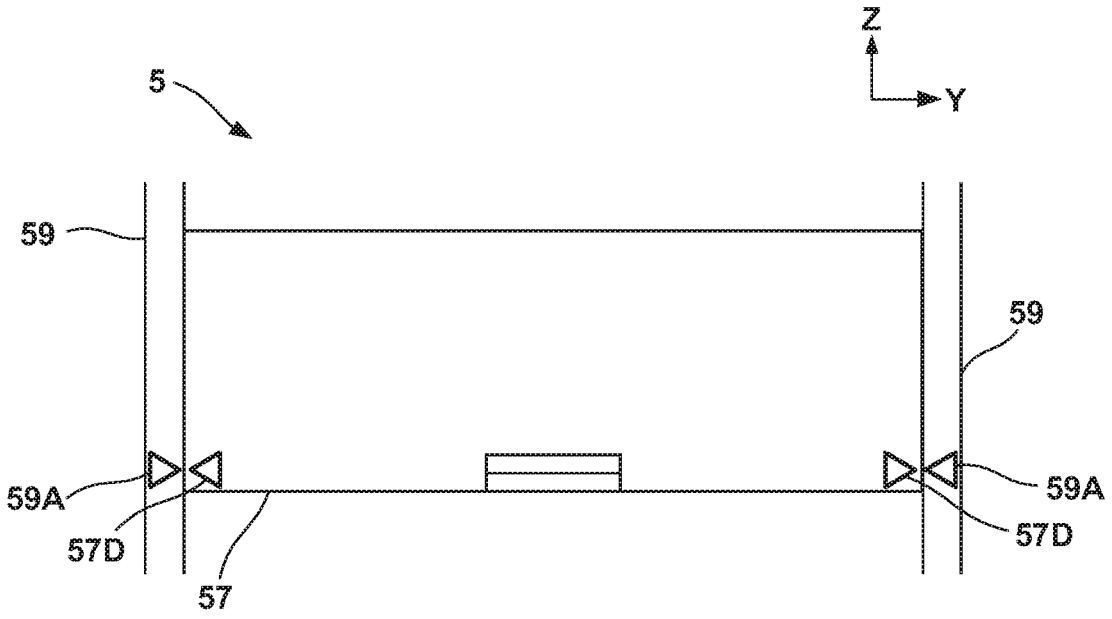
FIG. 18 is a front view showing another arrangement example of the drying promotion unit.

FIG. 18 is a front view showing another arrangement example of the second drying promotion unit 50. In this arrangement example, alignment portions 59A for performing alignment upon attaching the second drying promotion unit 50 to attachment portions 59 are provided. On the other hand, alignment portions 57D are provided on the accommodation portion 57 of the second drying promotion unit 50. In this arrangement example, the alignment portions 59A and 57D are triangle marks. By aligning the vertical positions of the alignment portions 59A and 57D, the second drying promotion unit 50 can be aligned with the attachment portions 59.

The mark shapes of the alignment portions 59A and 57D can be appropriately designed. For example, horizontal bars, or the like may be used. In addition, it is also possible to employ an arrangement in which the alignment portions 59A are provided only on the attachment portions 59 and, for example, the upper or lower end of the accommodation portion 57 is aligned with the alignment portion 59A. Further, as another mode of the alignment portions 59A, it is also possible to employ, for example, an arrangement in which guide members protruding from the attachment portions 59 to the side on which the second drying promotion unit 50 is attached are provided.

Arrangement Example 4

Figure 19A:
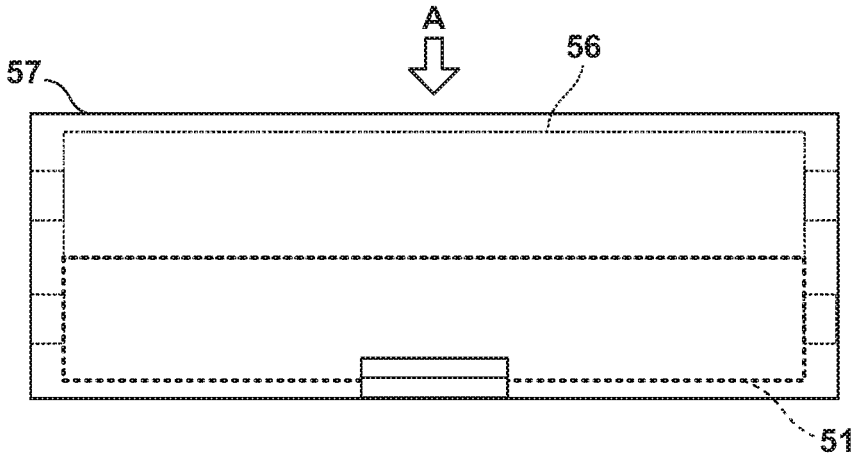
FIG. 19A is a front view showing still another arrangement example of the drying promotion unit.
Figure 19B:
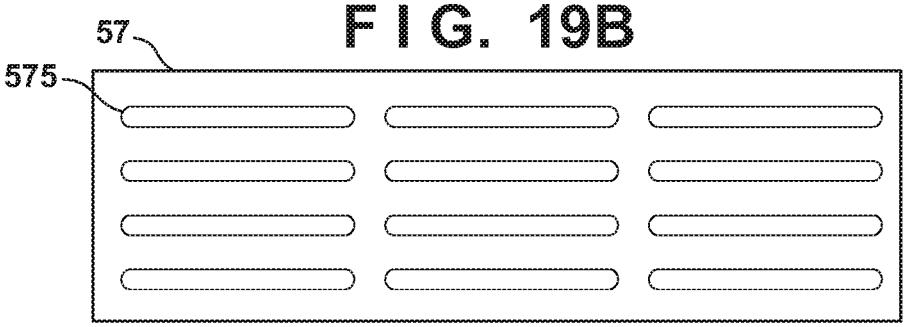
FIG. 19B is a view taken in the direction of an arrow A in FIG. 19A and showing an example of openings formed in the drying promotion unit.
Figure 19C:
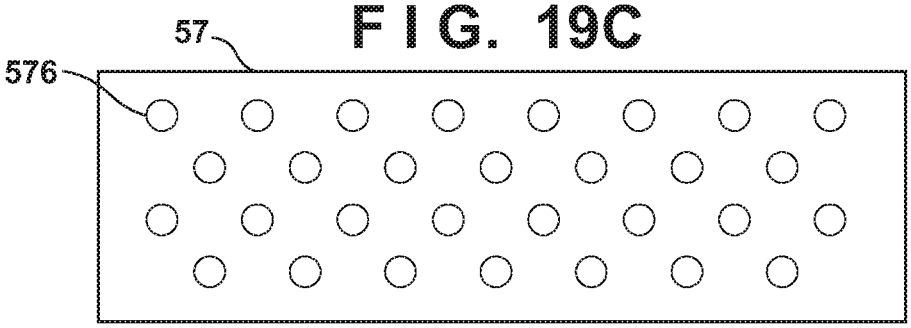
FIG. 19C is a view taken in the direction of the arrow A in FIG. 19A and showing another example of the openings formed in the drying promotion unit.
Figure 19D:
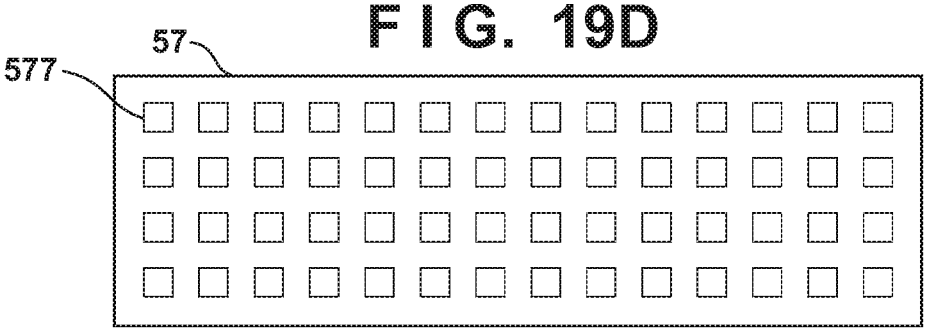
FIG. 19D is a view taken in the direction of the arrow A in FIG. 19A and showing still another example of the openings formed in the drying promotion unit.

FIG. 19A is a front view showing another arrangement example of the second drying promotion unit 50, and FIGS. 19B to 19D are views (top views) each taken in the direction of an arrow A in FIG. 19A and showing an example of openings formed in the second drying promotion unit 50. Note that the reference numerals of the openings are partially omitted in FIGS. 19B to 19D.

The second drying promotion unit 50 is configured to surround the heating element 51, which is the heat source, with the accommodation portion 57. Accordingly, heat is readily retained in the accommodation portion 57, and it may take time for the second drying promotion unit 50 to fall to a temperature at which it can be removed. Therefore, in this embodiment, openings that make the inside and the outside of the accommodation portion 57 communicate with each other are formed. Thus, the heat inside the accommodation portion 57 is dissipated, and the temperature decrease of the second drying promotion unit 50 can be further promoted.

Examples of the openings include slit-shaped openings 575 (FIG. 19B), punch holes 576 (FIG. 19C), lattice-shaped openings 577 (FIG. 19D), or the like formed in the upper surface of the accommodation portion 57. For example, these openings may be formed in a size that does not allow the user's finger to enter. With this arrangement, it is possible to promote the temperature decrease of the second drying promotion unit 50 while preventing the user from touching the roller 56 or the like in a high temperature state. In this arrangement example, the openings are formed in the upper surface of the accommodating portion 57, but they may be formed in the side surface, the lower surface, or the like.

Another Embodiment

In the above-described embodiment, the second drying promotion unit 50 has been described as an example, but the present invention can also be applied to a unit such as the first drying promotion unit 40 that can reach a high temperature. The constituent members of the first drying promotion unit 40 can also reach a hot temperature due to warm air, and in that case, it is desirable to prevent the user from touching them. Therefore, the opening operation of the cover member 5*d* may be restricted if the first drying promotion unit 40 is considered to be at a high temperature.

The temperature threshold value for restricting the opening operation of the cover member 5*d* may be different from the temperature threshold value for releasing the restriction. That is, the temperature threshold value may have hysteresis. For example, there may be a temperature gradient in the accommodation portion 57, so that there may be a portion in the accommodation portion 57 where the actual temperature is higher than the temperature detected by the temperature sensor 55. For example, by setting the temperature threshold value for releasing the restriction lower than the temperature threshold value for restricting the opening operation, it is possible to suppress the exposure of the second drying promotion unit 50 in the high temperature state.

In addition, the situation may be limited in which information indicating that the opening operation is being restricted or information indicating that the opening operation is not being restricted is displayed on the display unit 7*a*. For example, the restricting mechanism controller 19 may instruct the operation unit 7 to display the information only when the user is likely to open the cover member 5*d*, such as when a jam has occurred or when the user is prompted to replace the second drying promotion unit 50. Further, in the above-described embodiment, the above-described information related to the restriction of opening operation is notified to the user by display on the display unit 7*a*, but another mode can also be employed as the mode of notification. For example, the apparatus main body 2 may include a loudspeaker or the like, and the loudspeaker may notify the above-described information by audio output. Furthermore, for example, the above-described information may be transmitted to a terminal owned by the user by wireless communication or the like, and the above-described information may be displayed on the terminal owned by the user.

Other Embodiments

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-164785, filed Sep. 10, 2019, which is hereby incorporated by reference herein in its entirety.

What is claimed is:

1. A printing apparatus comprising:

a printing unit configured to print an image on a print medium;

a heating unit configured to heat the print medium with the image printed thereon;

a detection unit configured to detect a temperature of the heating unit;

a housing configured to accommodate the heating unit;

a cover member provided on the housing and configured to be capable of being opened and closed, with the cover member covering the heating unit in a closed state;

a restricting unit capable of restricting an opening operation of the cover member; and a control unit configured to control the restricting unit so as to execute the restriction if the temperature of the heating unit rises to a temperature that exceeds a first threshold value, with the control unit not releasing the restriction until the temperature of the heating unit falls from the first threshold value to a second threshold value that is lower than the first threshold value, and with the control unit releasing the restriction if the temperature of the heating unit is not more than the second threshold value.

2. The apparatus according to claim 1, further comprising a notification unit configured to notify a user with information indicating that the restricting unit is restricting the opening operation.

3. The apparatus according to claim 1, further comprising a notification unit configured to notify a user with information indicating that the restricting unit is not restricting the opening operation.

4. The apparatus according to claim 1, wherein the restricting unit comprises:

a displacement member provided on the housing and capable of being displaced between a restriction position at which the opening operation of the cover member is restricted and a release position at which the restriction is released;

an actuator provided on the housing and configured to drive the displacement member; and an engaging portion provided on the cover member and configured to engage with the displacement member so as to restrict the opening operation in a state in which the displacement member is set in the restriction position.

5. The apparatus according to claim 1, wherein the cover member is provided so as to cover an opening formed in the housing in a case where the cover member is in a closed state, and wherein the heating unit is detachable from the housing via the opening.

6. The apparatus according to claim 1, wherein the heating unit includes a plurality of grip portions spaced apart from each other.

7. The apparatus according to claim 6, wherein the heating unit includes a roller that is extended in a widthwise direction crossing a conveyance direction of the print medium, and the roller is pressed against the print medium, and wherein the plurality of grip portions are provided on both end portion sides of the roller.

8. The apparatus according to claim 5, wherein the heating unit includes a main body of the heating unit, and a grip portion that is pivotable with respect to the main body, and wherein the grip portion is pivotable between an extended state in which the grip portion stands upright with respect to the main body and a retracted state in which the grip portion lies down with respect to the main body.

9. The apparatus according to claim 8, wherein in a case where the cover member is opened, the grip portion in the retracted state is exposed.

10. The apparatus according to claim 8, wherein a pivot shaft of the grip portion is provided above a center of gravity of the main body.

11. The apparatus according to claim 5, further comprising an alignment portion provided on a side of the housing and capable of aligning the heating unit with the housing.

12. The apparatus according to claim 1, wherein the heating unit includes an accommodation portion configured to accommodate a heat source of the heating unit, and wherein an opening that makes an inside and an outside of the accommodation portion communicate with each other is formed in the accommodation portion.

13. The apparatus according to claim 1, wherein the printing unit prints an image by discharging liquid to the print medium, and wherein the heating unit promotes drying of the liquid by contacting and heating an image printing surface of the print medium.

14. The printing apparatus according to claim 1, wherein the heating unit includes a heater and a roller, and wherein the heater and the roller nip the print medium.

15. The printing apparatus according to claim 14, further comprising a second heating unit configured to heat the print medium with the image printed thereon by blowing air.

16. The printing apparatus according to claim 13, wherein the printing unit is a full-line head having nozzles that are arrayed in an area corresponding to a width of the print medium.

17. The apparatus according to claim 1, further comprising a conveyance unit configured to convey the print medium to a direction, wherein the heating unit is arranged on downstream of the printing unit in the direction.

18. A control method of a printing apparatus including:

a printing unit configured to print an image on a print medium;

a heating unit configured to heat the print medium with the image printed thereon;

a housing configured to accommodate the heating unit;

a cover member provided on the housing and configured to be capable of being opened and closed, with the cover member covering the heating unit in a closed state; and a restricting unit capable of restricting an opening operation of the cover member, the method comprising:

detecting a temperature of the heating unit; and controlling the restricting unit so as to execute the restriction if the temperature of the heating unit rises to a temperature that exceeds a first threshold value, with the restriction not being released until the temperature of the heating unit falls from the first threshold value to a second threshold value that is lower than the first threshold value, and with the restriction being released if the temperature of the heating unit is not more than a second threshold value.

19. A printing apparatus comprising:

a printing unit configured to print an image on a print medium by discharging liquid to the print medium through a nozzle;

a conveyance unit to convey the print medium in a direction;

a heating unit configured to heat the print medium with the image printed thereon, the heating unit being arranged downstream of the printing unit in the direction;

a detection unit configured to detect a temperature of the heating unit;

a housing configured to accommodate the printing unit and the heating unit;

a cover member provided on the housing and configured to be capable of being opened and closed, with the cover member covering the heating unit in a closed state;

a restricting unit capable of restricting an opening operation of the cover member; and a control unit configured to control the restricting unit so as to execute the restriction if the temperature of the heating unit exceeds a first threshold value, and release the restriction if the temperature of the heating unit is not more than a second threshold value that is lower than the first threshold value.

* * * * *